US008548339B2

(12) United States Patent
Ishikawa

(10) Patent No.: US 8,548,339 B2
(45) Date of Patent: Oct. 1, 2013

(54) CARTRIDGES, SUCH AS DEVELOPER CARTRIDGES, FOR AN IMAGE FORMING APPARATUS, SUCH AS A PRINTER

(75) Inventor: Satoru Ishikawa, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/104,959

(22) Filed: May 10, 2011

(65) Prior Publication Data

US 2011/0211864 A1 Sep. 1, 2011

Related U.S. Application Data

(63) Continuation of application No. 12/039,378, filed on Feb. 28, 2008, now Pat. No. 7,953,330.

(30) Foreign Application Priority Data

Feb. 28, 2007 (JP) ..... 2007-050724
Feb. 28, 2007 (JP) ..... 2007-050725
Aug. 30, 2007 (JP) ..... 2007-224187

(51) Int. Cl.
*G03G 15/00* (2006.01)

(52) U.S. Cl.
USPC ..... 399/12; 399/13

(58) Field of Classification Search
USPC ..... 399/12, 13, 111, 119, 262
See application file for complete search history.

(56) References Cited

U.S. PATENT DOCUMENTS 6,115,568 A 9/2000 Sameshima
6,879,789 B2 4/2005 Yamada et al.
6,920,298 B2 7/2005 Yamada et al.
6,944,417 B2 9/2005 Yamada et al.
6,990,301 B2 1/2006 Yamada et al.
7,039,347 B2 5/2006 Yamada et al.

(Continued)

FOREIGN PATENT DOCUMENTS

CN 1828446 A 9/2006
CN 1828450 A 9/2006

(Continued)

OTHER PUBLICATIONS

Japan Patent Office, Written Opinion and International Search Report for International Application No. PCT/JP2008/053734 (counterpart to co-pending U.S. Appl. No. 12/039,378), mailed Apr. 22, 2008.

(Continued)

*Primary Examiner* — Walter L Lindsay, Jr.
*Assistant Examiner* — Barnabas Fekete
(74) *Attorney, Agent, or Firm* — Baker Botts L.L.P.

(57) ABSTRACT

A cartridge includes an engagement gear which includes a first engaging portion and is configured to selectively rotate. The cartridge also includes a rotational body which includes a second engaging portion, and a center axis of the rotational body is aligned with a center axis of the engagement gear. Moreover, the cartridge includes an extension portion which is positioned offset from a center of rotation of the rotational body. The engagement gear and the rotational body are configured to selectively be positioned in one of a first state in which the second engaging portion and the first engaging portion are separated from each other, and a second state in which the second engaging portion engages the first engaging portion. The rotational body is configured to rotate with the engagement gear when the engagement gear rotates and the engagement gear and the rotational body are in the second state.

4 Claims, 21 Drawing Sheets

(56) References Cited

U.S. PATENT DOCUMENTS

| | | | |
|---|---|---|---|
| 7,116,931 | B2 | 10/2006 | Yamada et al. |
| 7,127,193 | B2 | 10/2006 | Yamada et al. |
| 7,324,777 | B2 | 1/2008 | Yamada et al. |
| 7,376,369 | B2 | 5/2008 | Yamada et al. |
| 7,382,997 | B2 | 6/2008 | Yamada et al. |
| 7,386,251 | B2 | 6/2008 | Yamada et al. |
| 7,463,834 | B2 | 12/2008 | Takagi et al. |
| 2005/0047818 | A1 | 3/2005 | Yamada et al. |
| 2006/0008290 | A1 | 1/2006 | Yamada et al. |
| 2006/0193645 | A1 | 8/2006 | Kishi |
| 2006/0193646 | A1 | 8/2006 | Suzuki et al. |
| 2007/0098454 | A1 | 5/2007 | Yamada et al. |
| 2007/0212118 | A1 | 9/2007 | Nagae et al. |

FOREIGN PATENT DOCUMENTS

| | | | |
|---|---|---|---|
| EP | 1696278 | A | 8/2006 |
| EP | 1696284 | A2 | 8/2006 |
| JP | H05-165323 | A | 7/1993 |
| JP | H06-258910 | A | 9/1994 |
| JP | H10-301464 | A | 11/1998 |
| JP | 2002-318490 | A | 10/2002 |
| JP | 2003-202727 | A | 7/2003 |
| JP | 2003-316227 | A | 11/2003 |
| JP | 2005-180962 | A | 7/2005 |
| JP | 2006-039216 | A | 2/2006 |
| JP | 2006-162946 | A | 6/2006 |
| JP | 2006-243071 | A | 9/2006 |
| JP | 2006-267994 | A | 10/2006 |
| JP | 2006-309147 | A | 11/2006 |

OTHER PUBLICATIONS

Japan Patent Office, Notice of Reasons for Rejection for Japanese Patent Application No. 2007-050725 (counterpart to co-pending U.S. Appl. No. 12/039,378), mailed Jul. 13, 2010.

Patent Office of the People'S Republic of China, The First Office Action for Chinese Patent Application No. 200810082536.7 (counterpart to above-captioned patent application), mailed Nov. 27, 2009.

State Intellectual Property Office of the People'S Republic of China, The Second Office Action for Chinese Patent Application No. 200810082536.7 (counterpart to the above-captioned patent application), mailed Aug. 4, 2010.

State Intellectual Property Office of the People'S Republic of China, The Third Office Action for Chinese Patent Application No. 200810082536.7 (counterpart to the above-captioned patent application), mailed Dec. 27, 2010.

State Intellectual Property Office of the People'S Republic of China, The Fourth Office Action for Chinese Patent Application No. 200810082536.7 (counterpart to the above-captioned patent application), mailed Feb. 22, 2012.

The State Intellectual Property Office of the People'S Republic of China, The Decision of Rejection for Chinese Patent Application No. 200810082536.7 (counterpart Chinese patent application), mailed Nov. 22, 2012.

REAR ⟷ FRONT

| EXTENSION PORTION MOVING TIME | $\alpha$ | $\beta$ |
|---|---|---|
| TYPE | FOR 3000 SHEETS | FOR 6000 SHEETS |

208

CARTRIDGES, SUCH AS DEVELOPER CARTRIDGES, FOR AN IMAGE FORMING APPARATUS, SUCH AS A PRINTER

CROSS-REFERENCE TO RELATED APPLICATIONS

This application is a continuation of U.S. patent application No. 12/039,378, filed Feb. 28, 2008, which claims priority from Japanese Patent Application No. 2007-050724, which was filed on Feb. 28, 2007, Japanese Patent Application No. 2007-050725, which was filed on Feb. 28, 2007, and Japanese Patent Application No. 2007-224187, which was filed on Aug. 30, 2007, the disclosures of which are herein incorporated by reference in their entirety.

BACKGROUND OF THE INVENTION

1. Field of the Invention

The present invention relates generally to a cartridge which may be configured to store a developing agent therein, and to be selectively attached to and detached from an image forming apparatus, such as a printer.

2. Description of Related Art

A known developer cartridge may be configured to store toner therein, to be selectively attached to and detached from a known image forming apparatus, such as a laser printer. The known image forming apparatus may be configured to determine a condition of the installed developer cartridge, i.e., whether an installed developer cartridge is a new cartridge or a used cartridge, and to determine a type of the installed developer cartridge.

The known image forming apparatus includes a swingable arm-like actuator, a spring which urges the actuator toward a first position, a sensor configured to detect the swing of the actuator, and a controller configured to determine the condition of the developer cartridge and to determine the type of developer cartridge based on signals outputted from the sensor. The known developer cartridge includes one or two contact protrusions which protrude from a shaft portion, a detection gear configured to rotate about the shaft portion together with the contact protrusion(s), and a gear mechanism configured to engage the detection gear and to transmit a driving force to a developing roller.

As the developer cartridge including a single contact protrusion is attached to a main body of the image forming apparatus, the contact protrusion applies a force to a first end of the actuator, and the actuator swings and the sensor detects the swinging of the actuator. A signal detected by the sensor is transmitted to the controller as a first detection signal. The controller then determines that the installed developer cartridge is a new cartridge when the controller receives the first detection signal.

For example, when a front cover of the image forming apparatus is closed after the developer cartridge is attached to the main body of the image forming apparatus, the controller performs a warm-up operation including an idle rotation. During the idle rotation, an agitator rotates to agitate toner stored in the developer cartridge.

A transmission force from a drive source, which is provided at the main body of the image forming apparatus, is transmitted to the agitator and to the detection gear, which are provided at the developer cartridge, via the gear mechanism, to perform the idle rotation. By the transmission of the force, the agitator starts the agitation of the toner and the contact protrusion further moves and applies the force to the first end of the actuator, and thus, the contact protrusion disengages from the actuator at a second position. Subsequently, the actuator returns to the first position due to the urging force from the spring. When the developer cartridge includes two contact protrusions, a first of the contact protrusions applies the force to the first end of the actuator, and a second of the contact protrusions then applies a force to the first end of the actuator to further swing the actuator. The second swing of the actuator is detected by the sensor, and a signal detected by the sensor is transmitted to the controller as a second detection signal.

Specifically, the controller determines that the type of the installed developer cartridge is type A, e.g., a cartridge configured to form images on a maximum of 6000 sheets, when the controller receives the second detection signal, and determines that the type of the installed developer cartridge is type B e.g., a cartridge configured to form images on a maximum of 3000 sheets, when the controller does not receive the second detection signal.

If, however, a user inadvertently rotates the developing roller or a gear positioned in the gear mechanism or the known developer cartridge, the detection gear may rotate in synchronization with the gear mechanism, and the contact protrusion(s) may move to an undesired position(s). Then, the actuator and the sensor may not correctly detect the contact protrusion(s).

SUMMARY OF THE INVENTION

Therefore, a need comprises arisen for cartridges which overcome these and other shortcomings of the related art. A technical advantage of the present invention is that the cartridge may be configured to minimize displacement of an extension portion of the cartridge, e.g., a portion corresponding to the contact protrusion of the known cartridge, when an undesired rotational force is transmitted to an engagement gear, e.g., by a user.

According to an embodiment of the present invention, a cartridge comprises an engagement gear which comprises a first engaging portion and is configured to selectively rotate. For example, in an embodiment, the engagement gear may be configured to rotate on an arc, such that the engagement gear is configured to selectively rotate over an area which is less than 360 degrees. The cartridge also comprises a rotational body comprising a second engaging portion, and a center axis of the rotational body is aligned with a center axis of the engagement gear. Moreover, the cartridge comprises an extension portion which is positioned offset from a center of rotation of the rotational body. The engagement gear and the rotational body are configured to selectively shift between a first state in which the second engaging portion and the first engaging portion are separated from each other, and a second state in which the second engaging portion engages the first engaging portion. The rotational body is configured to rotate with the engagement gear when the engagement gear rotates and the engagement gear and the rotational body are in the second state.

Other objects, features, and advantages will be apparent to persons of ordinary skill in the art from the following detailed description and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-19C, like numerals being used for like corresponding portions in the various drawings.

Figure 1:
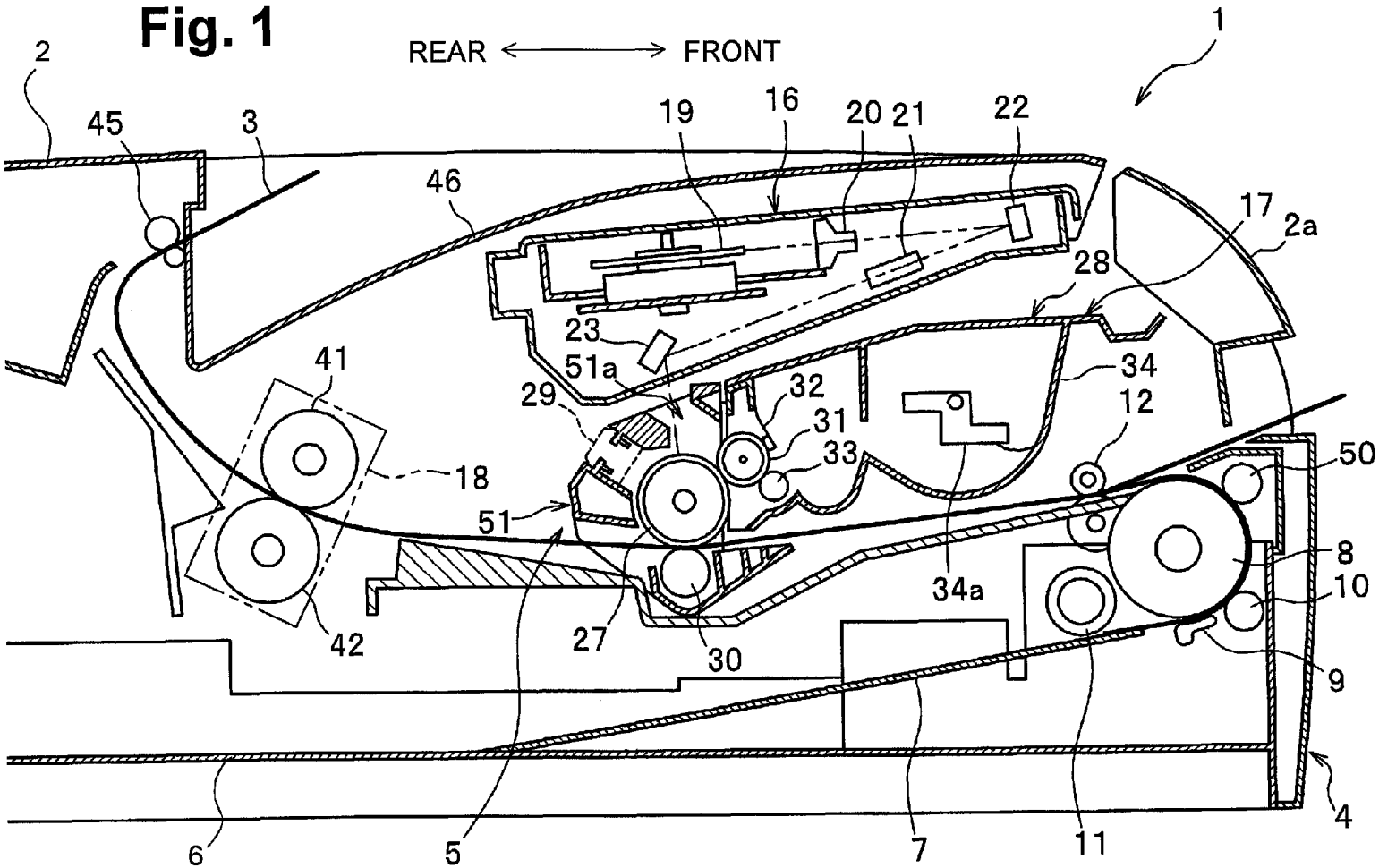
FIG. 1 is a side, cross-sectional view of a laser printer, according to an embodiment of the present invention.

Referring to FIG. 1, an image forming apparatus, e.g., a laser printer 1, a coping machine, a multi-function device, or the like, may comprise a main body, e.g., a body casing 2, a feeder unit 4 configured to feed a sheet 3 to the body casing 2, and an image forming unit 5 configured to form an image onto the fed sheet 3. The body casing 2 may comprise an openable front cover 2*a* at its front side.

The feeder unit 4 may comprise a sheet supply tray 6 and a sheet pressing plate 7. The sheet supply tray 6 may be configured to be selectively attached to and detached from a bottom portion of the body casing 2. The sheet pressing plate 7 may be positioned in the sheet supply tray 6. The feeder unit 4 further may comprise a feed roller 11, a supply roller 8, a supply pad 9, a pinch roller 10, and a sheet dust removing roller 50. The feed roller 11 may be positioned above a first end of the sheet supply tray 6. The supply roller 8, the supply pad 9, the pinch roller 10, and the sheet dust removing roller 50 may be positioned downstream from the feed roller 11 with respect to a conveying direction of the sheet 3. The feeder unit 4 further may comprise a register roller 12 which may be positioned downstream from the sheet dust removing roller 50 in the sheet conveying direction.

A plurality of sheets 3 may be stacked in the sheet supply tray 6. The sheets 3 placed on the sheet supply tray 6 are supplied toward the feed roller 11 by the sheet pressing plate 11 and then are fed between the supply roller 8 and the supply pad 9 by the feed roller 11. A topmost sheet 3 in the stack then is supplied and is conveyed, one by one, by the supply roller 8 and the supply pad 9, to the image forming unit 5 by passing through the pinch roller 10, the sheet dust removing roller 50, and the resist roller 12.

The image forming unit 5 may comprise a scanner unit 16, a process cartridge 17, and a fixing unit 18. The scanner unit 16 may be positioned at an upper portion of the body casing 2. The scanner unit 16 may comprise a laser emitting portion (not shown), a rotatable polygon mirror 19, lenses 20 and 21, and reflectors 22 and 23. A laser beam (indicated by a double dot and dashed line in FIG. 1) emitted from the laser emitting portion based on image data, passes through or is reflected off of the polygon mirror 19, the lens 20, the reflector 22, the lens 21, and the reflector 23 in this order, and is irradiated onto a surface of a photosensitive drum 27 of the process cartridge 17 during a high-speed scanning process.

The process cartridge 17 may be configured to be selectively attached to and detached from the body casing 2 by which the front cover 2*a* is opened. The process cartridge 17 may comprise a cartridge, e.g., a developer cartridge 28, and a drum unit 51.

The developer cartridge 28 may be configured to be selectively attached to and detached from the body casing 2 via the drum unit 51. For example, the developer cartridge 28 may be configured to be selectively attached to and detached from the drum unit 51 which is fixed to the body casing 2. The attachment and detachment of the developer cartridge 28 with respect to the body casing 2 may be implemented by the developer cartridge 28 alone, i.e., the drum unit 51 remains in the body casing 2, or by the process cartridge 17 including the developer cartridge 28 engaged with the drum unit 51.

The developer cartridge 28 may comprise a developing roller 31, a layer-thickness regulating blade 32, a toner supply roller 33, a toner hopper 34, and an agitator 34*a*. Toner stored in the toner hopper 34 is agitated by the agitator 34*a* and then is supplied onto the developing roller 31 by the toner supply roller 33. The toner then is positively charged by friction between the toner supply roller 33 and the developing roller 31. The toner supplied onto the developing roller 31 then is provided between the layer-thickness regulating blade 32 and the developing roller 31 by the rotation of the developing roller 31, and becomes a thin layer, of uniform thickness, on the developing roller 31.

The drum unit 51 may comprise the photosensitive drum 27, a scorotron changer 29, and a transfer roller 30. The photosensitive drum 27 is rotatably supported by a housing of the drum unit 51. The photosensitive drum 27 may comprise a drum body which is connected to a ground. The drum body comprises a positively-charged photosensitive layer on its surface. The drum unit 51 comprises an exposure window 51*a* which is an opening formed in the housing of the drum unit 51. The drum unit 51 is positioned, such that the exposure window 51*a* is positioned above the photosensitive drum 27.

The scorotron charger 29 is positioned diagonally above the photosensitive drum 27, e.g., above and behind the photosensitive drum 27, Referring to FIG. 1, such that there is a predetermined distance between the scorotron charger 29 and the photosensitive drum 27. The scorotron charger 29 is an electrifier that generates corona discharge from, for example, a tungsten charging wire, in order to uniformly positively charge the surface of the photosensitive drum 27.

The transfer roller 30 is positioned under the photosensitive drum 27 and contacts the photosensitive drum 27. The transfer roller 30 is rotatably supported by the housing of the drum unit 51. The transfer roller 30 may comprise a roller shaft comprising metal, and a roller portion covered with a conductive rubber material. A transfer bias is applied to the transfer roller 30 by a constant-current control during transfer.

After the surface of the photosensitive drum 27 is uniformly positively charged by the scorotron charger 29, the surface of the photosensitive drum 27 is exposed to the laser beam emitted from the scanner unit 16 by the high-speed scanning process, and an electrostatic latent image is formed on the surface of the photosensitive drum 27 based on predetermined image data. When the formed electrostatic latent image on the surface of the photosensitive drum 27 faces and contacts the developing roller 31, the positively charged toner held on the developing roller 31 is supplied to and held on portions of the surface of photosensitive drum 27 that correspond to the formed electrostatic latent image. Specifically, the portion of the surface of the photosensitive drum 27 that was exposed by the laser beam emitted by the scanner unit 16 and corresponds to the formed electrostatic latent image comprises a lower electric potential than those portions not exposed by the laser beam of the photosensitive drum 27. Thus, the electrostatic latent image formed on the photosensitive drum 27 is visualized when the generally positively charged toner adheres to the lower potential portion of the surface of the photosensitive drum 21. Development of the electrostatic image is thereby accomplished, i.e., a toner image is formed on the surface of the photosensitive drum 27.

Subsequently, the photosensitive drum 27 and the transfer roller 30 rotate to convey the sheet 3 while pinching the sheet 3 therebetween. With this operation, the toner image held on the surface of the photosensitive drum 27 is transferred onto the sheet 3.

The fixing unit 18 may be positioned downstream of the process cartridge 17 in the sheet conveying direction when the process cartridge 17 is attached to the body casing 2. The fixing unit 18 may comprise a heat roller 41 and a pressing roller 42. The pressing roller 42 faces and applies a force to the heat roller 41. At the fixing unit 18, the toner transferred onto the sheet 3 is thermally fixed onto the sheet 3 while the sheet 3 passes between the heat roller 41 and the pressing roller 42. The sheet 3 on which the toner comprises been fixed is further conveyed to a discharge roller 45, which may be positioned downstream from the fixing unit 18 in the sheet conveying direction. The sheet 3 then is discharged onto a sheet discharge tray 46 by the discharge roller 45.

Figure 2:
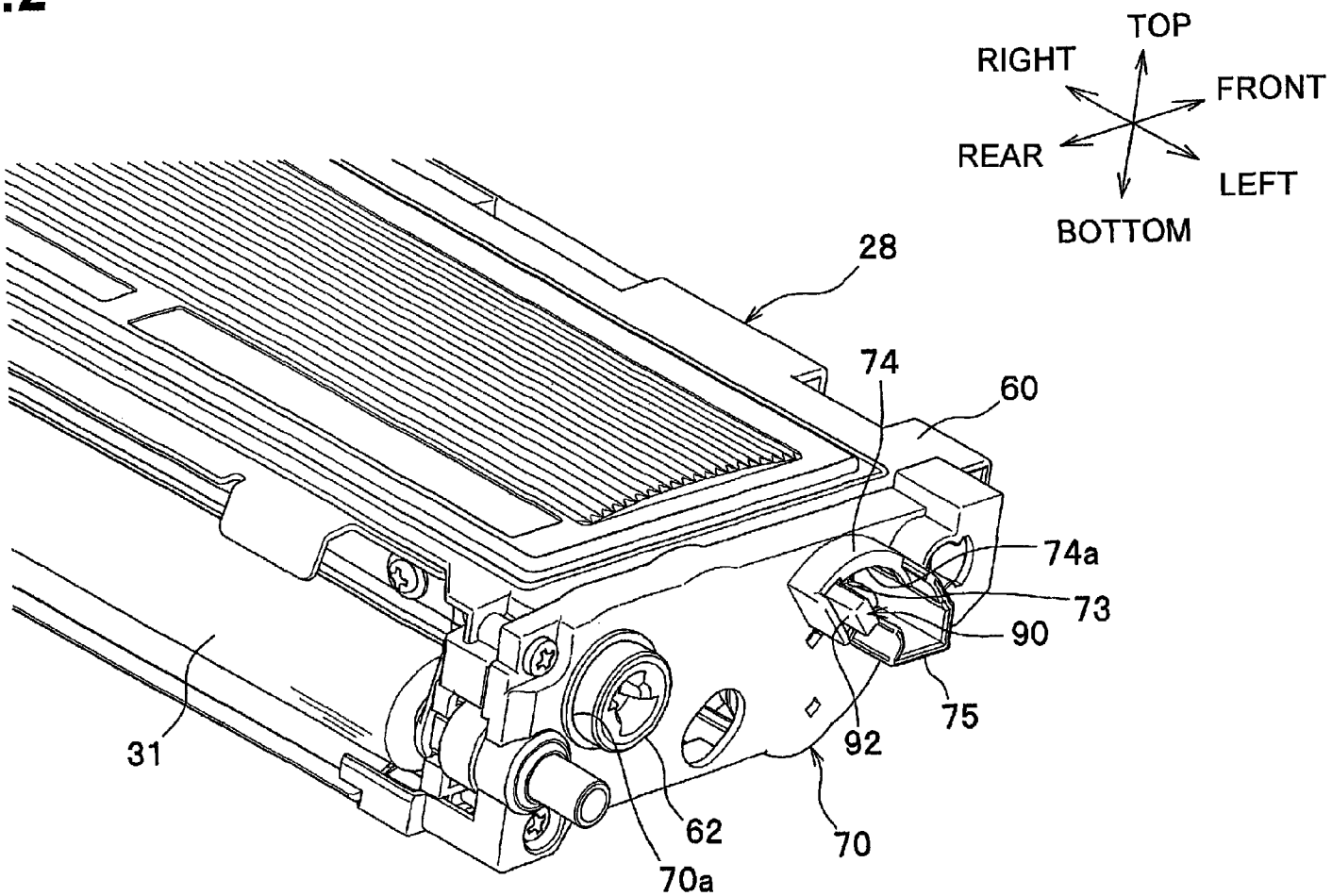
FIG. 2 is a perspective view of a developer cartridge, according to an embodiment of the present invention, in which the developer cartridge may be configured to form images on a maximum of 3000 sheets.
Figure 3:
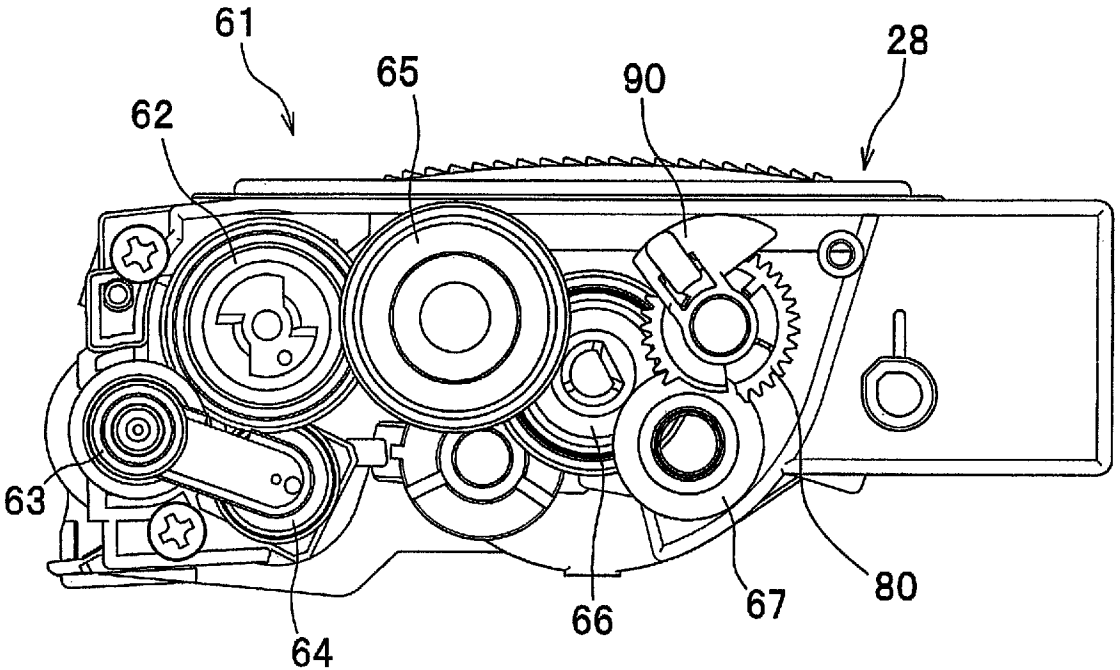
FIG. 3 is a left side view of the developer cartridge of FIG. 2, in which a cover member is omitted.

Referring to FIG. 2, the developer cartridge 28 may comprise the developing roller 31, an inner housing, e.g., a cartridge body 60, and a cover member 70. The cover member 70 may be configured to be selectively attached to and detached from one side, e.g., a left side, of the cartridge body 60. Referring to FIG. 3, the developer cartridge 28 may comprise a gear mechanism 61, an engagement gear 80, and a rotational body 90, between the cartridge body 60 and the cover member 70. The gear mechanism 61 may be configured to transmit a drive force to the developing roller 31. The engagement gear 80 and the rotational body 90 may be configured to be unreversibly rotatable in one direction. The rotational body 90 may comprise a gear configured to be rotatable by receiving a force from the engagement gear 80.

Figure 6:
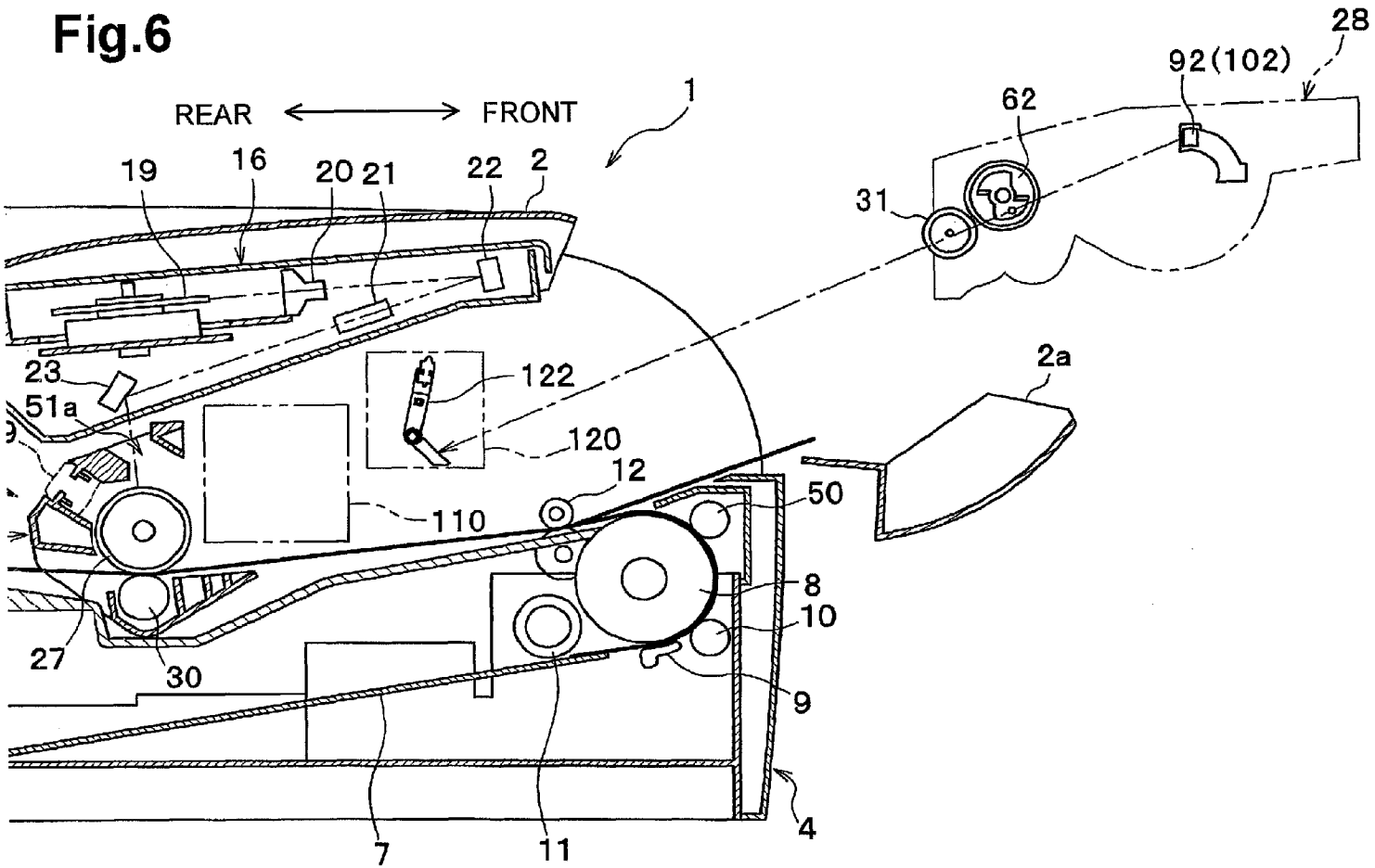
FIG. 6 is a side, cross-sectional view of the laser printer of FIG. 1, in which the developer cartridge is separated from a body casing of the laser printer.

Referring to FIGS. 3 and 6, the gear mechanism 61 may comprise an input gear 62, a developing roller drive gear 63, a toner supply roller drive gear 64, an agitator drive gear 66, and a transmission gear 67. A drive force is transmitted to the input gear 62 from a drive device 110 positioned in the body casing 2. The developing roller drive gear 63 and the toner supply roller drive gear 64 are configured to directly engage the input gear 62. The agitator drive gear 66 may be configured to engage the input gear 62 via an intermediate gear 65. The transmission gear 67 may be configured to directly engage the agitator drive gear 66. Referring to FIG. 1, the developing roller drive gear 63, the toner supply roller drive gear 64, and the agitator drive gear 66 may be configured to drive the developing roller 31, the toner supply roller 33, and the agitator 34*a*, respectively, and may be integral with respective ends of shafts of the developing roller 31, the toner supply roller 33, and the agitator 34*a*.

Figures 4A, 4B, 4C:
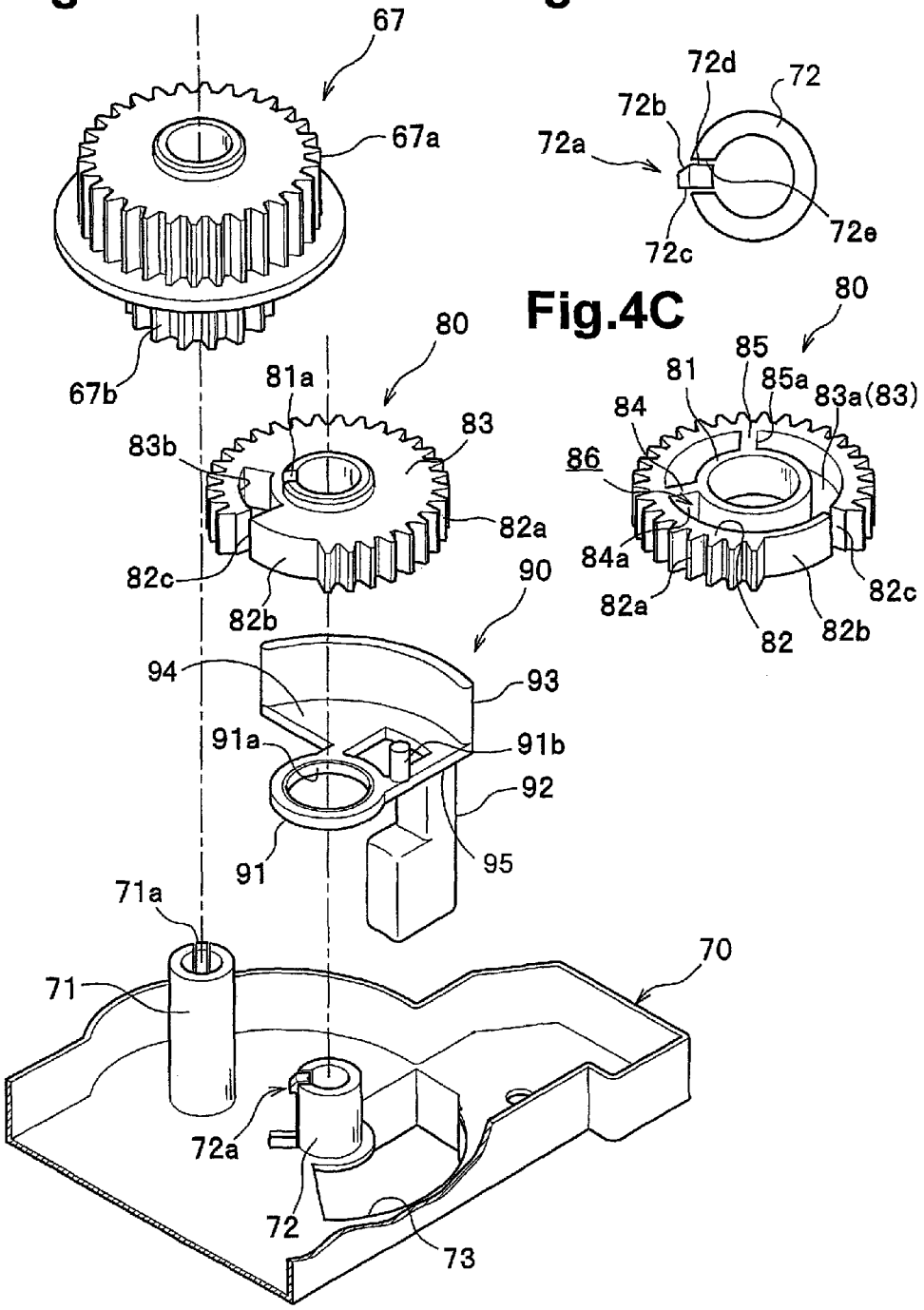
FIG. 4A is an enlarged, right side, perspective view of a cover member and a gear mechanism of the developer cartridge of FIG. 2 when viewed from the inside of the developer cartridge of FIG. 2.
FIG. 4B is a right side, plan view of an engaging portion of a second support shaft portion on the cover member.
FIG. 4C is a left side, perspective view of a left side of the gear mechanism of FIG. 4A.

Referring to FIG. 3, the transmission gear 67 may comprise a reduction gear configured to reduce the speed of rotation of the engagement gear 80. Referring to FIG. 4A, the transmission gear 67 may comprise a larger-diameter gear portion 67*a* and a smaller-diameter gear portion 67*b*. The larger-diameter gear portion 67*a* may be configured to engage the agitator drive gear 66. The smaller-diameter gear portion 67*b* comprises a diameter which is less than the larger-diameter gear portion 67*a*, and may be configured to engage the engagement gear 80. The transmission gear 67 is rotatably supported by a first cylindrical support shaft portion 71 provided on an inner surface of the cover member 70. A portion of the first support shaft portion 71 may comprise a hook-like retaining portion 71 a configured to be deformable in a diameter direction of the first support shaft portion 71 and to retain the transmission gear 67 in the first support shaft portion 71.

Referring to FIG. 4C, the engagement gear 80 may comprise an inner cylindrical portion 81, an outer cylindrical portion 82 having a diameter which is greater than the inner cylindrical portion 81, and a connection wall 83 which connects edges of the inner cylindrical portion 81 to the outer cylindrical portion 82.

The inner cylindrical portion 81 of the engagement gear 80 is rotatably supported by a shaft portion, e.g., a second cylindrical support shaft portion 72, positioned on the inner surface of the cover member 70. The inner cylindrical portion 81 comprises an engaging groove 81*a* at first end opposite a second end facing the cover member 70. The engaging groove 81*a* may be configured to engage an engaging portion 72*a* positioned at a tip of the second support shaft portion 72. A set of the engaging portion 72*a* and the engaging groove 81*a* may be positioned with respect to the cover member 70 and the engagement gear 80.

The engaging portion 72*a* is deformable in a diameter direction of the second support shaft portion 72. A tip of the engaging portion 72*a* comprises a hook-like portion protruding outwardly in the diameter direction of the second support shaft portion 72. Referring to FIG. 4B, the hook-like tip portion of the engaging portion 72*a* comprises a first contact surface 72*b* and a second contact surface 72*c*. The first contact surface 72*b* may be inclined with respect to the diameter direction of the second support shaft portion 72, and may contact a wall of the engaging groove 81*a* of the engagement gear 80 in a rotational direction of the engagement gear 80. The second contact surface 72*c* extends along the diameter direction of the second support shaft portion 72 and in a direction perpendicular to the rotational direction of the engagement gear 80. The engagement gear 80 is rotatable in a predetermined direction, e.g., a counterclockwise direction in FIGS. 4A and 4B.

A base portion of the engaging portion 72*a* may comprise a surface 72*d* which continues from the first contact surface 72*b* and extends in a direction orthogonal to the rotational direction of the engagement gear 80. The second support shaft portion 72 may comprise a support portion, e.g., a support surface 72*e*, extending along the surface 72*d* and facing the surface 72*d*. A slight gap is formed between the surface 72*d* of the engaging portion 72*a* and the support surface 72*e* of the second support shaft portion 72. With this structure, the clockwise rotation of the engagement gear 80 is restricted. Specifically, if the engagement gear 80 rotates in the clockwise direction in FIG. 4A, the second contact surface 72*c* is urged by a wall of the engaging groove 81*a* of the engagement gear 80, and the engaging portion 72*a* is deformed in the rotational direction of the engagement gear 80, such that the surface 72*d* of the engaging portion 72*a* is surely supported by the support surface 72*e*.

The outer cylindrical portion 82 of the engagement gear 80 may comprise a toothed portion 82*a* and a toothless portion 82*b*. The toothed portion 82*a* is partially formed on a peripheral surface of the outer cylindrical portion 82. A driving, rotational force is transmitted to the toothed portion 82*a* from the transmission gear 67 when the toothed portion 82*a* of the engagement gear 80 engages the transmission gear 67. The toothless portion 82*b* occupies the peripheral surface where the toothed portion 82*a* does not occupy. The toothless portion 82*b* does not engage the transmission gear 67. The engagement gear 80 comprises a slit 82*c* in the peripheral surface of the outer cylindrical portion 82*a* and at a border between the toothed portion 82*a* and the toothless portion 82*b*. The slit 82*c* extends along an axial direction of the engagement gear 80.

The connection wall 83 extends in a direction perpendicular to the rotational axis of the engagement gear 80. Referring to FIG. 4C, the engagement gear 80 may comprise a first regulating rib 84 and a first engaging portion, e.g., a second regulating rib 85, provided at predetermined positions on an inner surface 83*a* thereof. The first and second regulating ribs 84 and 85 may have a height which is the same as that of the inner cylindrical portion 81 and the outer cylindrical portion 82. With this structure, a portion surrounded by the first regulating rib 84, the second regulating rib 85, the inner cylindrical portion 81, the outer cylindrical portion 82, and the connection wall 83 is defined as a regulating groove 86. A surface 84*a* of the first regulating rib 84 and a surface 85*a* of the second regulating rib 85, which comprise the walls of the regulating groove 86, may be positioned on the same circumference of a circle and distanced away from each other in the rotational direction of the engagement gear 80.

Referring to FIG. 4A, a cutout portion 83*b* is partially positioned in the connection wall 83 and continues to the slit 82*c* of the outer cylindrical portion 82. The cutout portion 83*b* extends from the border between the toothed portion 82*a* and the toothless portion 82*b* to a predetermined position on the side of the toothed portion 82*a*. With this structure, the toothed portion 82*a* is partially deformable in the diameter direction of the outer cylindrical portion 82.

The rotational body 90 may comprise a plate portion, e.g., a rotational frame 91 having a substantially L-shape, an extension portion 92, and an arc-shaped rib 93. The extension portion 92 protrudes toward the cover member 70 from the rotational frame 91. The rib 93 protrudes from an edge of the rotational frame 91 toward a direction opposite to the direction that the extension portion 92 protrudes.

The rotational frame 91 may comprise an arm-like portion which has a length greater than a radius of the engagement gear 80. The rotational frame 91 comprises a circular opening 91*a* at a first end. The second support shaft portion 72 is fitted into the opening 91*a* of the rotational frame 91. Thus, the rotational frame 91 is rotatable about the second support shaft portion 72. A second end of the rotational frame 91 has an arc shape. The rotational frame 91 may comprise a second engaging portion, e.g., a projection 91*b* at a predetermined position between the one end and the other end thereof. The projection

91*b* protrudes toward the engagement gear 80. The rotational frame 91 comprises a surface 94 on which the projection 91*b* may be positioned and a surface 95 which is an opposite side of the surface 94 of the rotational frame 91.

The projection 91*b* is positioned within the regulating groove 86 of the engagement gear 80 when the rotational body 90 and the engagement gear 80 are assembled with each other. With this structure, the projection 91*b* of the rotational body 90 may selectively contact the first regulating rib 84 or the second regulating rib 85 of the engagement gear 80 in the rotational direction of the engagement gear 80. Specifically, the engagement gear 80 and the rotational body 90 selectively are in a first position in which the second regulating rib 85 and the projection 91*b* are separated from each other, or in a second position in which the second regulating rib 85 and the projection 91*b* are engaged with each other. As such, a predetermined gap may be formed between the second regulating rib 85 and the projection 91*b*, such that the rotational body 90 does not rotate unless the engagement gear 80 rotates by a predetermined amount in the counterclockwise direction in FIG. 4A.

The extension portion 92 may be positioned at a position shifted from the center of rotation of the rotational frame 91. For example, the extension portion 92 is formed on the other end of the rotational frame 91 and protrudes toward the outside from the cover member 70 when the rotational body 90 and the cover member 70 are assembled with each other. The extension portion 92 may be positioned on the surface 95 of the rotational frame 91.

The rib 93 may be entirely formed at the edge of the arc-shaped other end of the rotational frame 91. Rib 93 increases a strength of the rotational body 90.

Figure 5:
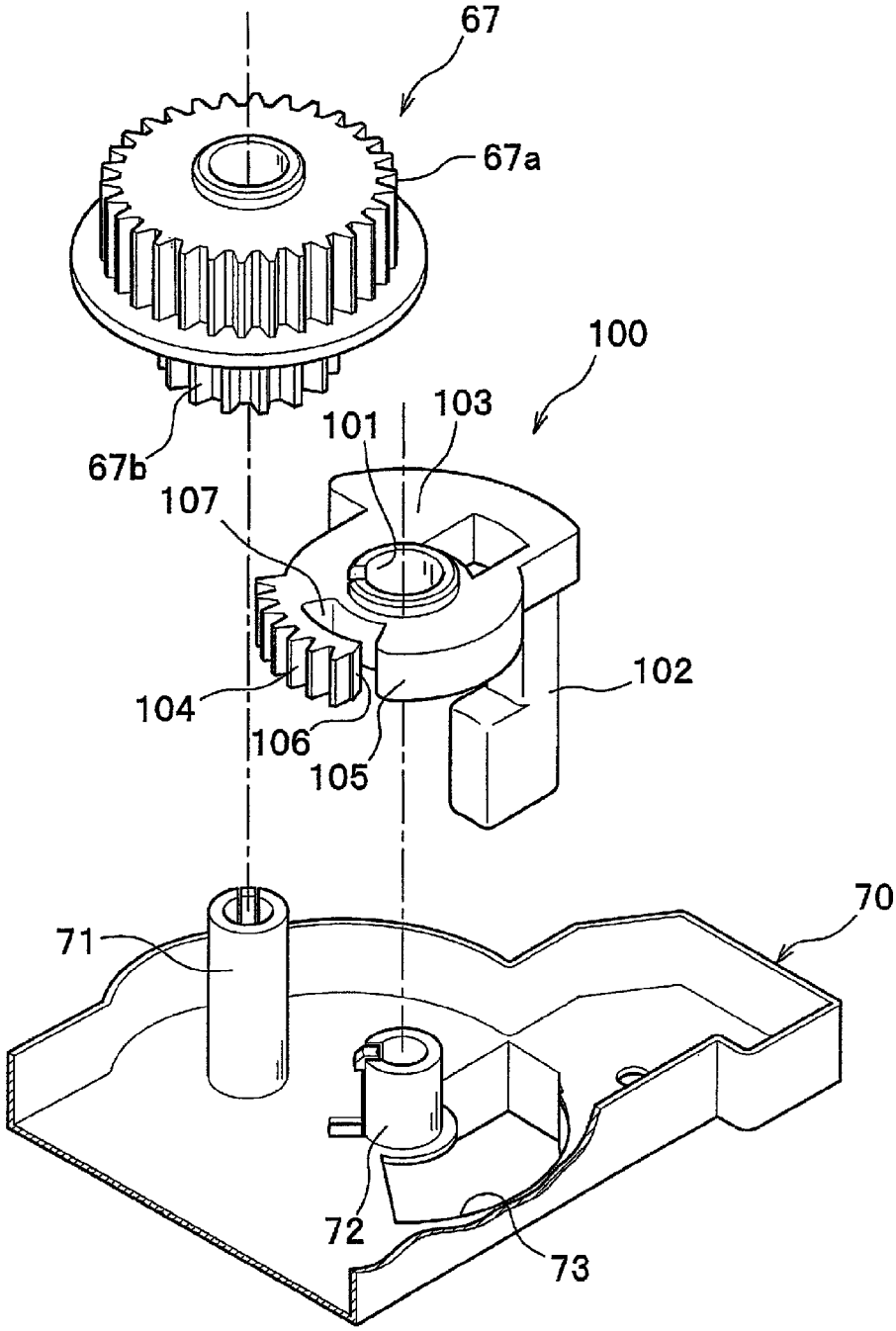
FIG. 5 is an enlarged, perspective view of a cover member, a rotational gear body, and a transmission gear of the developer cartridge of FIG. 1.

The transmission system configured to transmit the rotational force from the transmission gear 67 to the extension portion 92 may be designed in accordance with the types of the developer cartridge 28. As described above, referring to FIG. 4A, two components of the engagement gear 80 and the rotational body 90 comprise the transmission system of a first developer cartridge 28, e.g., a type of developer cartridge configured to form images on a maximum of 3000 sheets. Referring to FIG. 5, a single component of a gear rotational body 100 comprises the transmission system of a second developer cartridge 28, e.g., a developer cartridge configured to form images on a maximum of 6000 sheets. Hereinafter, merely a developer cartridge 28 may be referred to when the descriptions are common to the first and second developer cartridges 28.

Referring to FIG. 5, the gear rotational body 100 used in the second developer cartridge 28 may comprise a cylindrical shaft portion 101, an extension portion 102, and a connection frame 103. The shaft portion 101 is rotatably supported by the second support shaft portion 72 of the cover member 70 when the gear rotational body 100 and the cover member 70 are assembled with each other. The extension portion 102 is formed at a position shifted from a center of rotation of the gear rotational body 100. The connection frame 103 connects the shaft portion 101 to the extension portion 102. The connection frame 103 may comprise a toothed portion 104 at its base end side. The toothed portion 104 is partially formed on a peripheral surface of the connection frame 103 and engages the transmission gear 67. A toothless portion 105 occupies the peripheral surface where the toothed portion 104 does not occupy. The toothless portion 105 of the gear rotational body 100 does not engage the transmission gear 67. The connection frame 103 comprises a slit 106 and a cutout portion 107 at a border between the toothed portion 104 and the toothless portion 105. The slit 106 extends along an axial direction of the shaft portion 101. With this structure, the toothed portion 104 is partially deformable in a diameter direction of the gear rotational body 100. The gear rotational body 100 may comprise an engaging groove substantially similar to the engaging groove 81*a* positioned in the engagement gear 80.

Figure 7:
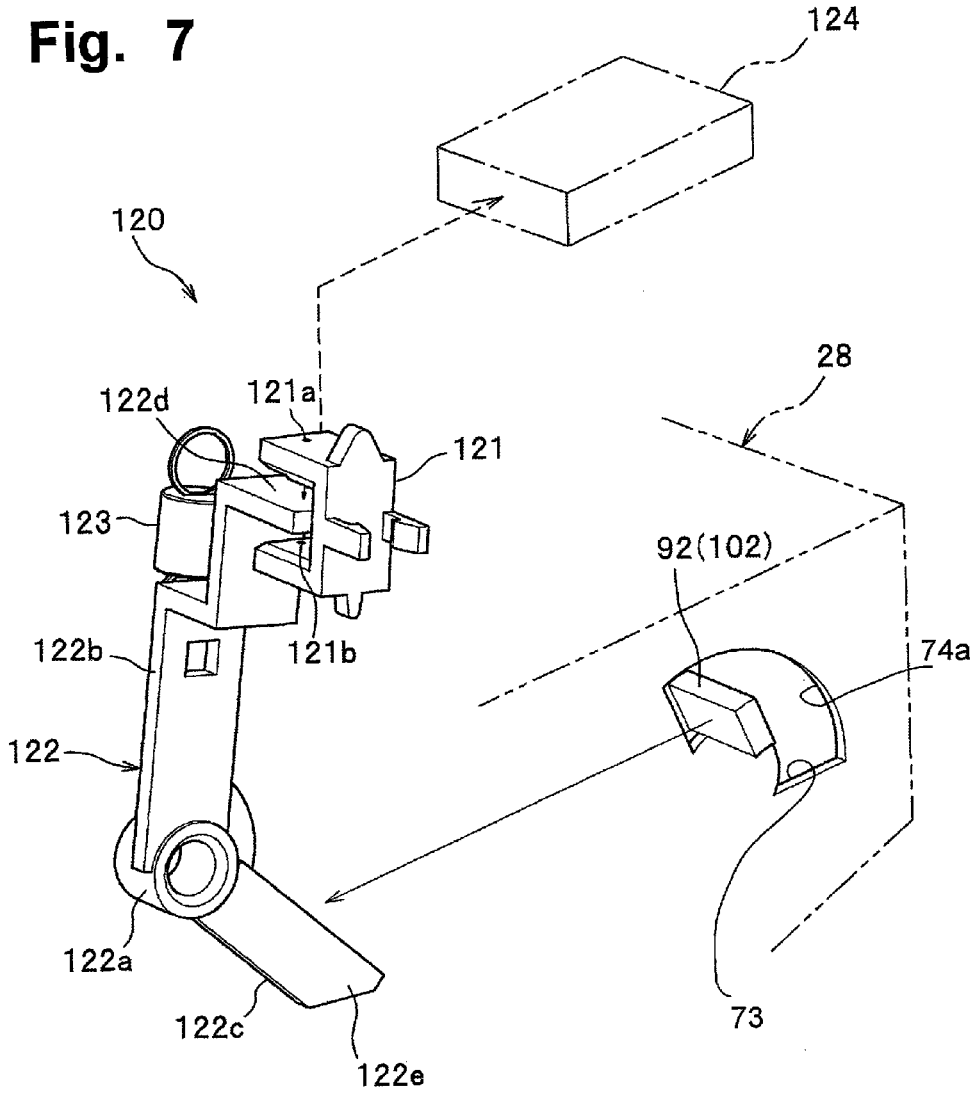
FIG. 7 is a perspective view of components comprising a cartridge condition and a cartridge type detector.

The cover member 70 is commonly used in the first and second developer cartridges 28. For example, Referring to FIG. 4A, the cover member 70 comprises an opening, e.g., an elongated groove 73, having an arc shape, and the first and second support shaft portions 71 and 72. The extension portion 92 of the rotational body 90 or the extension portion 102 of the gear rotational body 100 passes through the elongated groove 73 to protrude to the outside when the rotational body 90 or the gear rotational body 100 is assembled with the cover member 70. Referring to FIG. 2, the cover member 70 comprises a groove surrounding wall 74 and an opening 70*a*. The groove surrounding wall 74 protrudes outward, e.g., leftward in FIG. 2, from an edge of the elongated groove 73. The input gear 62 is exposed to the outside through the opening 70*a*. The groove surrounding wall 74 may comprise a protection wall 75 at its front side. The protection wall 75 surrounds the extension portion 92 of the rotational body 90 or the extension portion 102 of the gear rotational body 100 from three directions, e.g., the rear, the front, and the bottom. With this structure, the protection wall 75 protects the extension portion 92, 102 from an application of an external force from the three directions. In addition, a contact wall 74*a* may be positioned at an upper arc portion of the groove surrounding wall 74 and protrudes downward, i.e., toward the extension portion 92 of the rotational body 90, from the grove surrounding wall 74. Referring to FIG. 7, the contact wall 74*a* is partially provided to the arc portion of the groove surrounding wall 74, such that a predetermined gap may be formed at both end portions of the arc portion. With this structure, the extension portion 92 of the rotational body 90 contacts and slides over the contact wall 74*a* when the engagement gear 80 and the rotational body 90 take any of states shown in FIGS. 10B-10D. A protruding amount of the contact wall 74*a* is selected, such that a resistance to the extension portion 92 by the contact with the contact wall 74*a* becomes less than the drive force to be transmitted from the transmission gear 67 and becomes greater than the urging force to be applied to the extension portion 92 from the detection arm 122 when the developer cartridge 28 is attached to the body casing 2.

The groove surrounding wall 74 may be shorter in height than the extension portion 92, 102, except the protection wall 75, such that a free end of the groove surrounding wall 74 is positioned at a level lower than a free end of the extension portion 92, 102. Therefore, the extension portion 92, 102 contacts a portion of the body casing 2 in a front-rear direction at the cartridge installed position when the developer cartridge 28 is installed in the body casing 2 with the extension portion 92, 102 positioned at an initial position, e.g., a rear end position in the elongated groove 73, as shown in FIG. 2. The portion of the body casing 2 may comprise components of a device attached to the body casing 2, and may comprise the detection arm 122 of a cartridge condition and type detector 120, as shown in FIG. 6.

Referring to FIG. 6, the laser printer 1 may comprise the drive device 110, and the cartridge condition and type detector 120 at a portion in the body casing 2 where the developer cartridge 28 is to be installed. The drive device 110 may be configured to transmit a drive force to the input gear 62 of the developer cartridge 28. The cartridge condition and type detector 120 may be configured to detect whether the installed developer cartridge 28 is a new or a used cartridge, and to detect the type of the installed developer cartridge 28.

A new developer cartridge corresponds to a developer cartridge which has not been used for printing before, and the used developer cartridge corresponds to a developer cartridge which previously has been used for printing. Specifically, the developing roller of the new developer cartridge has not been driven before, and the developing roller of the used developer cartridge has been driven before.

The drive device 110 may comprise a plurality of gears (not shown) and a drive motor (not shown). When the developer cartridge 28 is attached to the body casing 2, one of the gears of the drive device 110 engages the input gear 62, such that the drive force from the drive motor is transmitted to the input gear 62 via the gears. In the drive device 110, the gear to be engaged with the input gear 62 may be configured to move toward and away from the developer cartridge 28 in synchronization with the opening and closing of the front cover 2*a*. The gear moves toward the developer cartridge 28 and engages the input gear 62 when the front cover 2*a* is closed. The gear moves away from the developer cartridge 28 and disengages from the input gear 62 when the front cover 2*a* is opened.

Referring to FIG. 7, the cartridge condition and type detector 120 may comprise a detector, e.g., an optical sensor 121, the detection arm 122, a coil spring 123, and a controller 124.

The optical sensor 121 may be configured to detect a swing of the detection arm 122. The optical sensor 121 may comprise a light emitting portion 121*a* and a light receiving portion 121*b*. The light emitting portion 121*a* may be configured to emit light therefrom. The light receiving portion 121*b* may be configured to receive the light emitted from the light emitting portion 121*a*. The optical sensor 121 may be configured to output a predetermined signal to the controller 124 when the light receiving portion 121*b* receives the light from the light emitting portion 121*a*.

The detection arm 122 may comprise a cylindrical portion 122*a*, a light interception arm 122*b*, and a contact arm 122*c*. The cylindrical portion 122*a* is inserted into a shaft (not shown) positioned at the body casing 2, such that the detection arm 122 is rotatable about the shaft. The light interception arm 122*b* and the contact arm 122*c* protrude from the cylindrical portion 122*a* in respective directions with respect to a diameter direction of the cylindrical portion 122*a*. The detection arm 122 may be configured to swing about the cylindrical portion 122*b*. A coil spring 123 is attached to an appropriate portion of the light interception arm 122*b* of the detection arm 122. Thus, the detection arm 122 is urged by the coil spring 123 to be in a predetermined position. When the detection arm 122 is located at the predetermined position, an end portion 122*d* of the light interception arm 122*b* is positioned between the light emitting portion 121*a* and the light receiving portion 121*b* to intercept the light traveling therebetween, and an end portion 122*e* of the contact arm 122*c* is located at a position where the end portion 122*e* may contact the extension portion 92, 102 of the developer cartridge 28 attached to the body casing 2.

The controller 124 may be configured to determine whether an installed developer cartridge 28 is a new developer cartridge based on whether the detection arm 122 has swung, i.e., whether the extension portion 92 of the rotational body 90 has moved, and may determine the type of the installed developer cartridge 28 based on an amount of time between when the driving of the drive device 110 begins and when the optical sensor 121 transitions to an off state. For example, the controller 124 may perform an idle rotation, i.e., the agitator 34*a* rotates to agitate the toner stored in the developer cartridge 28, based on a cover close detection signal outputted from a sensor configured to detect the closing of the front cover 2*a* or a signal outputted when power of the laser printer 1 is turned on. Then, the controller 124 detects the cartridge condition, e.g., whether the cartridge is new or used. and the cartridge type, e.g., whether the cartridge is the first developer cartridge or the second developer cartridge, based on a signal outputted from the optical sensor 121. The detection of the cartridge condition and the cartridge type will be later described in detail.

Referring to FIGS. 8A-12D, the actions of the engagement gear 80, the rotational body 90, and the detection arm 122 now will be described with respect to when two different types of developer cartridges 28 are installed in the body casing 2. In FIGS. 8A-9B, and FIGS. 12A-12D, a new developer cartridge 28 is illustrated. The actions of the engagement gear 80, the rotational body 90, and the detection arm 122 when the first developer cartridge 28 is to be installed in the body casing 2 will be described below.

Figure 8A:
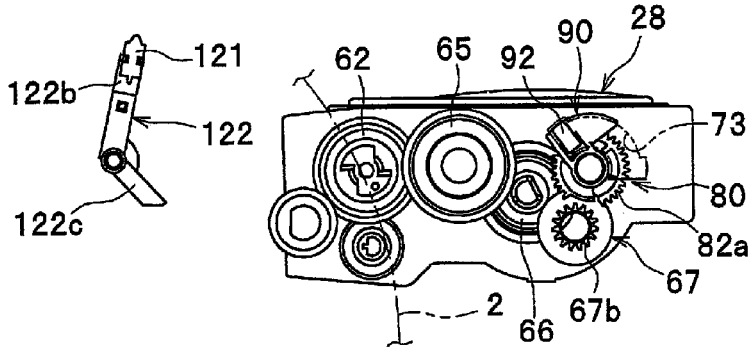
FIG. 8A is a diagram illustrating states of an extension portion, the engagement gear, the rotational body, and the transmission gear of the developer cartridge of FIG. 2, and a contact arm of the cartridge condition and cartridge type detector before the developer cartridge of FIG. 2 is installed in the laser printer of FIG. 1.

Referring to FIG. 8A, the extension portion 92 of the first developer cartridge 28 is located at the rear end position in the elongated groove 73, and the toothed portion 82*a* of the engagement gear 80 is located at a position separated from the transmission gear 67 when the developer cartridge 28 is not attached to the body casing 2. In this state, referring to FIG. 10A, the projection 91*b* of the rotational body 90 is located at a position adjacent to the first regulating rib 84 of the engagement gear 80. Specifically, the surface 84*a* of the first regulating rib 84 faces a surface of the projection 91*b* of the rotational body 90.

Figure 8B:
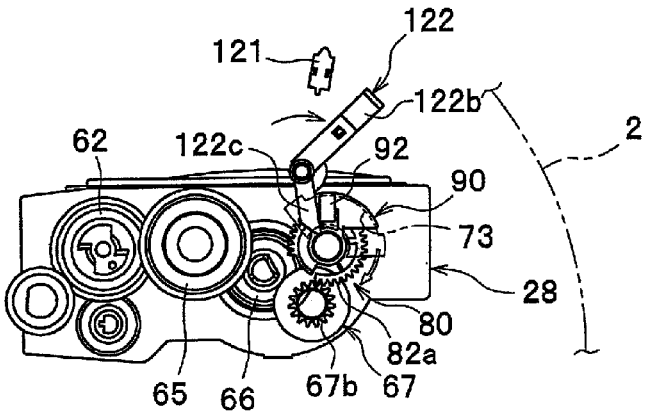
FIGS. 8B-9B are diagrams illustrating actions of the extension portion, the engagement gear, the rotational body, the transmission gear, and the contact arm when the developer cartridge of FIG. 2 is installed in the laser printer of FIG. 1.

Then, when the developer cartridge 28 is being inserted into the body casing 2, the extension portion 92 contacts and applies a force to the contact arm 122*c* of the detection arm 122, which is urged by the coil spring 123 to be located at the predetermined position. Referring to FIG. 8B, when the developer cartridge 28 is placed at the cartridge installed position in the body casing 2, the contact arm 122*c* of the detection arm 122 is urged toward the rear by the extension portion 92 against the urging force from the coil spring 123. By this operation, the detection arm 122 swings, such that the light interception arm 122*b* of the detection arm 122 moves toward the front. Because the light interception arm 122*b* moves away from the predetermined position, the light emitted from the light emitting portion 121*a* is received by the light receiving portion 121*b*, and the optical sensor 121 transitions to an on state and outputs a predetermined on signal to the controller 124. At that time, referring to FIG. 10B, a reverse force is applied to the extension portion 92 from the detection arm 122 being urged by the coil spring 123, such that the extension portion 92 moves toward the front. The extension portion 92 pressed by the contact arm 122*c* contacts the contact wall 74*a*, and a frictional force is applied to the extension portion 92 from the contact wall 74*a* while the extension portion 92 moves toward the front from the rear end position.

Figure 10A:
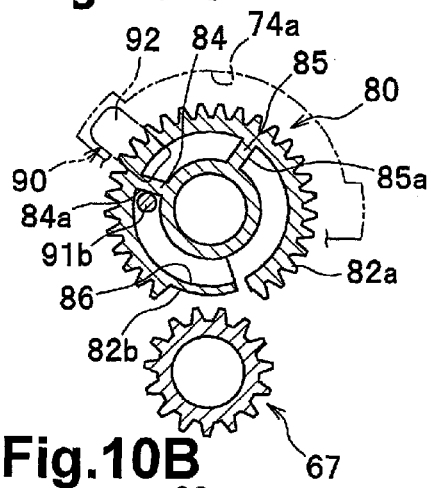
FIGS. 10A-10E are left side, sectional views of the extension portion, the engagement gear, the rotational body, and the transmission gear corresponding to their states and actions shown in FIGS. 8A-9B, respectively.
Figure 10B:
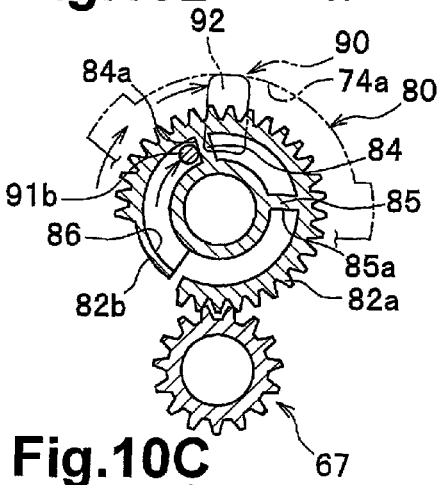

Referring to FIGS. 10A and 10B, when the extension portion 92 moves toward the front, the first regulating rib 84 is pushed toward the front by the projection 91*b*, and the engagement gear 80 rotates in the clockwise direction by a predetermined amount together with the rotational body 90, which causes the projection 91*b* of the rotational body 90 to contact the surface 84*a* of the first regulating rib 84. As the engagement gear 80 rotates, the toothed portion 82*a* of the engagement gear 80 contacts and engages the transmission gear 67. At that time, referring to FIGS. 11A and 11B, the engagement gear 80 rotates while pushing the engaging portion 72*a* inwardly, which causes a side wall of the engaging groove 81*a* to apply a force to the first contact surface 72*b* of the engaging portion 72*a* of the second support shaft portion 72.

As the optical sensor 121 outputs the on signal by detecting the swing of the detection arm 122, the controller 124 performs the idle rotation based on, for example, the cover close detection signal indicating the closing of the front cover 2*a*. After the idle rotation starts, the controller 124 continues to receive the on signal from the optical sensor 121.

Figure 8C:
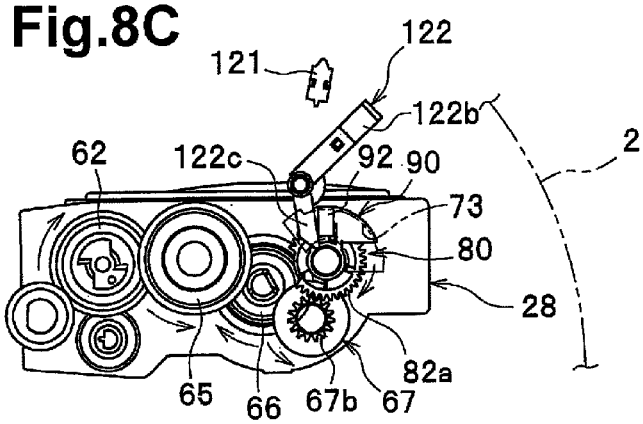

Referring to FIG. 8C, as the controller 124 begins the idle rotation, a drive force from the drive device 110 is transmitted to the toothed portion 82*a* of the engagement gear 80 via the input gear 62, the intermediate gear 65, the agitator drive gear 66, and the transmission gear 67, such that the engagement gear 80 rotates in the clockwise direction. At that time, Referring to FIG. 10C, the first regulating rib 84 is located in front of the projection 91*b* and the extension portion 92 engages the contact wall 74*a* with the predetermined frictional force, such that the first regulating rib 84 moves toward the front and is separated from the projection 91*b* retained at the predetermined position. Thus, only the engagement gear 80 rotates in the clockwise direction. Referring to FIG. 8C, because it is determined that the frictional force between the extension portion 92 and the contact wall 74*a* becomes greater than the urging force from the contact arm 122*c*, the extension portion 92 does not move when only the engagement gear 80 moves. Thus, the present position of the detection arm 122 is maintained, and the optical sensor 121 continues to output the on signal to the controller 124.

Figure 10C:
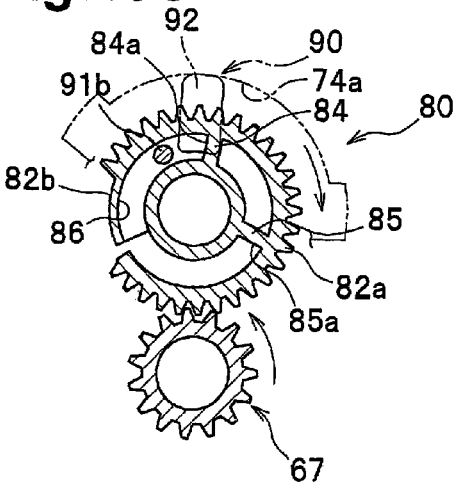
Figure 10D:
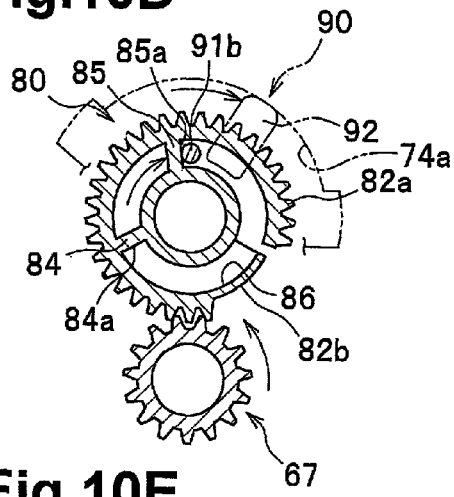

Then, referring to FIG. 10C, the second regulating rib 85 gradually moves toward the projection 91*b* as the engagement gear 80 further rotates relative to the rotational body 90. Referring to FIG. 10D, when the second regulating rib 85 and the projections 91*b* are engaged with each other, the projection 91*b* is pushed by the second regulating rib 85, and the rotational body 90 rotates together with the engagement gear 80. As the rotational body 90 rotates, the extension portion 92 further moves toward the front and disengages from the contact arm 122*c*, such that the detection arm 122 returns to the predetermined position by the urging force from the coil spring 123. Thus, the light interception arm 122*b* of the detection arm 122 also returns to its original position to intercept the light traveling between the light emitting portion 121*a* and the light receiving portion 121*b*, such that the optical sensor 121 transitions to the off state and stops the output of the on signal to the controller 124.

Figure 9A:
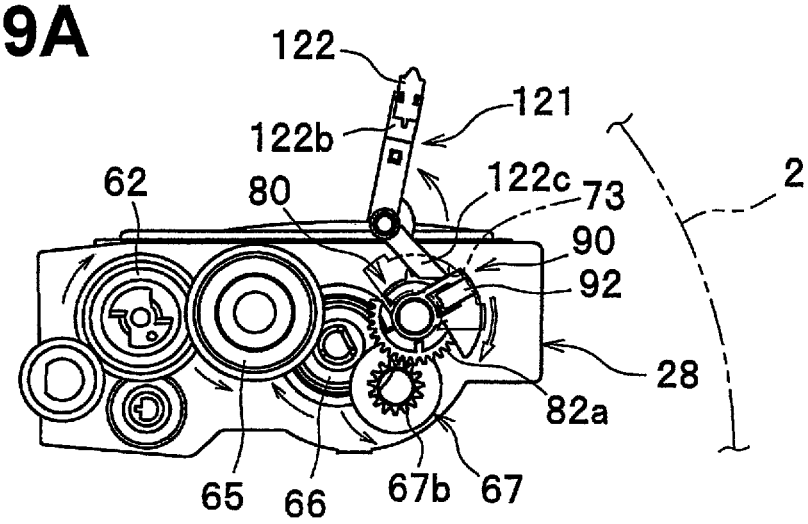
Figure 9B:
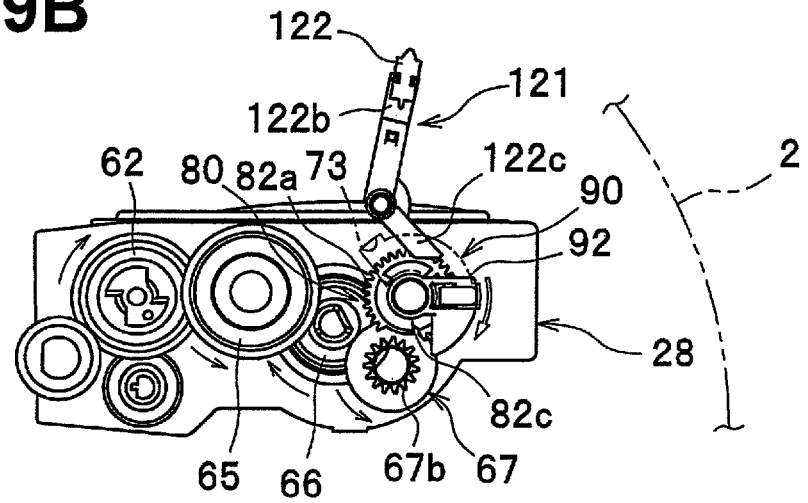
Figure 10E:
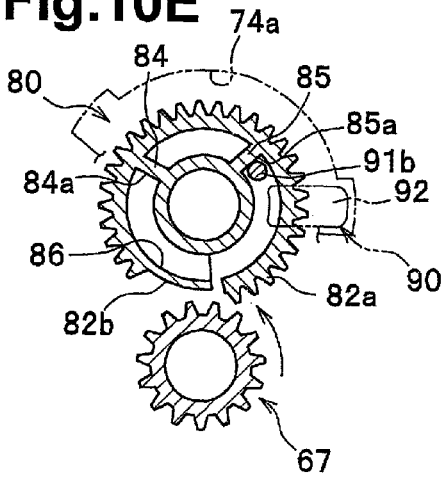
Figure 11A:
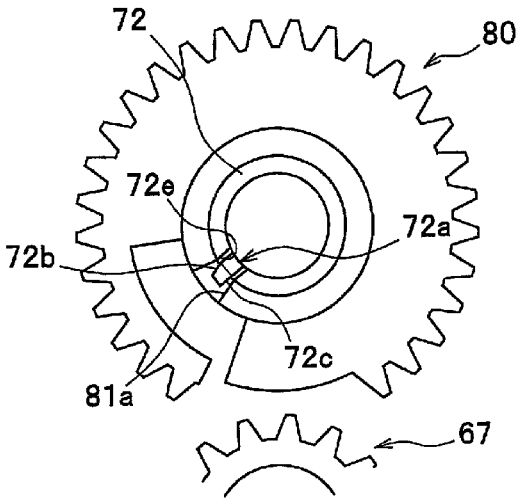
FIGS. 11A-11C are right side, plan views of the gear mechanism when viewed from the inside of the developer cartridge of FIG. 2, showing a relationship between the engaging portion and an engaging groove in the engagement gear.
Figure 11B:
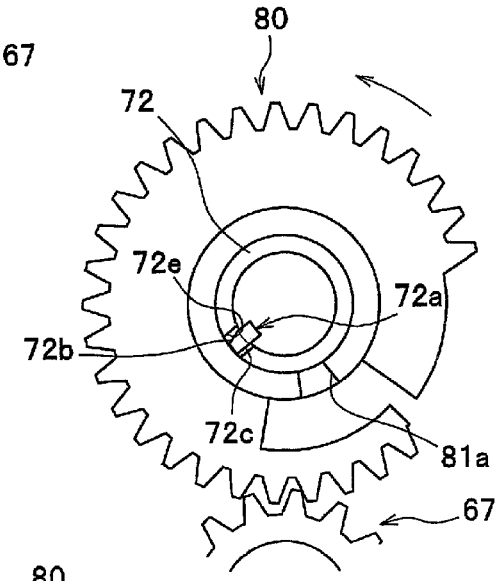
Figure 11C:
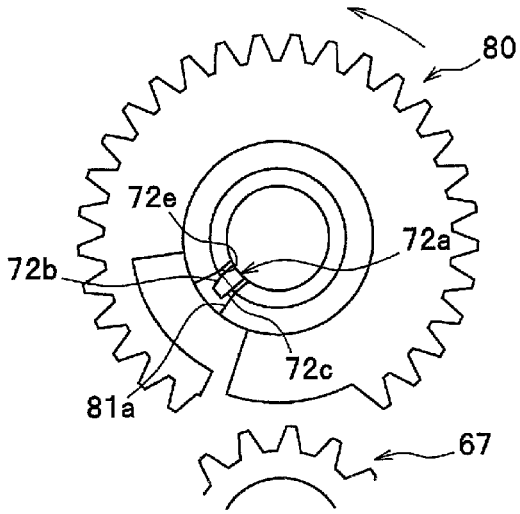

Subsequently, referring to FIGS. 9B and 10E, when the rotational body 90 further rotates in the clockwise direction and the extension portion 92 reaches a front end position in the elongated groove 73, the toothed portion 82*a* of the engagement gear 80 disengages from the transmission gear 67, and the rotation of the rotational body 90 is stopped. Specifically, the rotational body 90 rotates unreversibly. At that time, referring to FIG. 11C, the engaging groove 81*a* of the engagement gear 80 returns to its original position and again engages the engaging portion 72*a*. Thus, even when a force acting in the clockwise direction in FIG. 11 is applied to the engagement gear 80, the engaging groove 81*a* and the second contact surface 72*c* are engaged with each other, and the rotation of the engagement gear 80 is stopped, which causes the engaging portion 72*a* to deform in the rotational direction of the engagement gear 80. Thus, the engagement gear 80 is not allowed to again engage the transmission gear 67. Subsequently, the controller 124 completes the idle rotation and performs the cartridge condition and the cartridge type detection based on the presence or the absence of the on signal provided from the optical sensor 121 and a duration of time the controller 124 receives the on signal.

The actions of the engagement gear 80, the gear rotational body 100, and the detection arm 122 when the second developer cartridge 28 is to be installed in the body casing 2 will be described below. The actions of the engagement gear 80, the gear rotational body 100, and the detection arm 122 similar to the actions of those when the first developer cartridge 28 is attached to the body casing 2 are omitted.

Figures 12A, 12B, 12C, 12D:
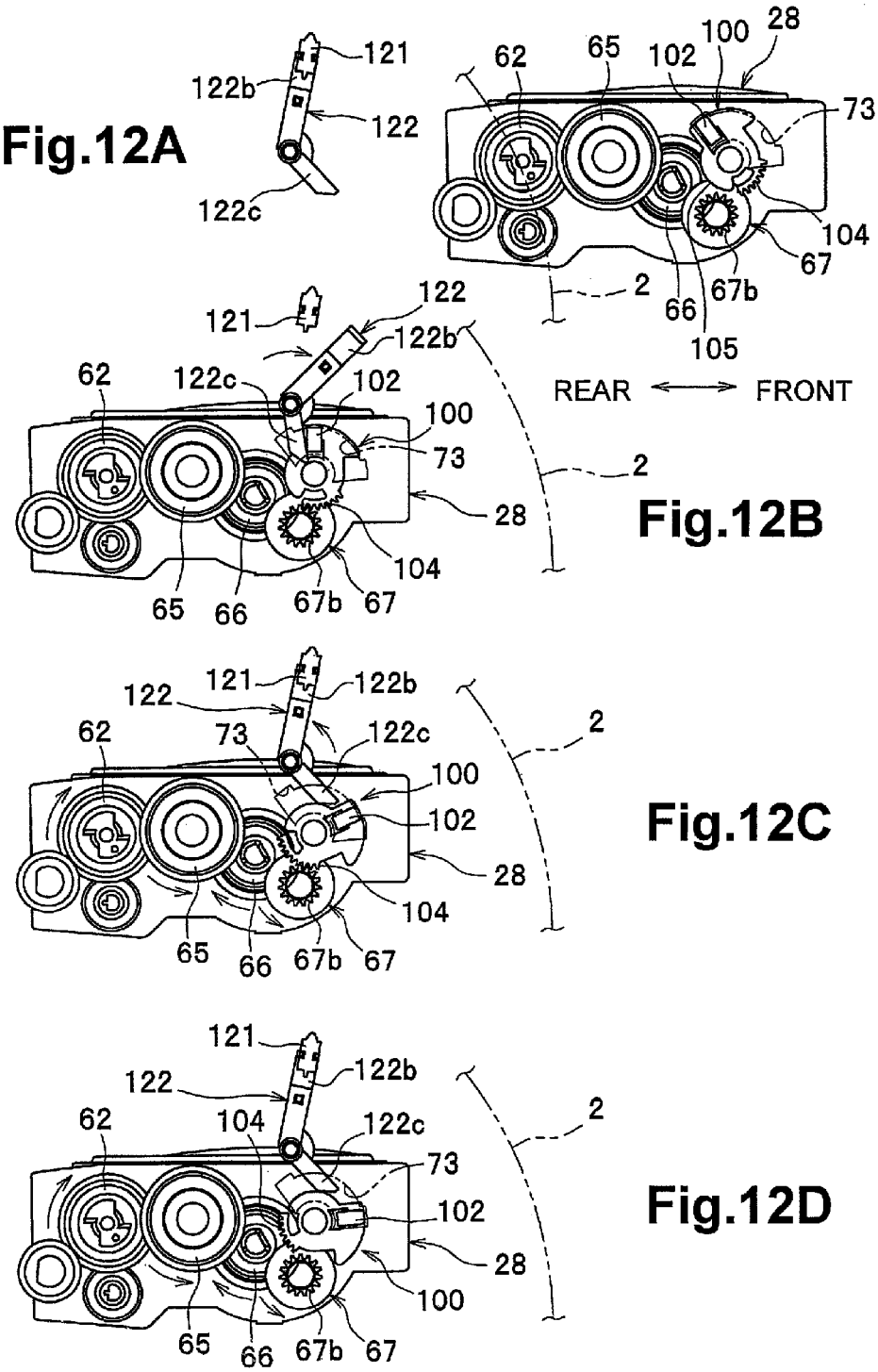
FIG. 12A is a diagram illustrating states of the extension portion, the engagement gear, the gear rotational body, and the transmission gear of a developer cartridge, according to another embodiment of the present invention, which may be configured to form images on a maximum of 6000 sheets, and the contact arm of the cartridge condition and the cartridge type detector before the developer cartridge is installed in the laser printer of FIG. 1.
FIGS. 12B-12D are diagrams illustrating actions of the extension portion, the engagement gear, the rotational body, the transmission gear, and the contact arm when the developer cartridge of FIG. 12A is installed in the laser printer of FIG. 1.

Referring to FIGS. 12A and 12B, when the second developer cartridge 28 is attached to the predetermined installed position in the body casing 2, the detection arm 122 swings toward the front, and the optical sensor 121 outputs an on signal to the controller 124.

Then, the controller 124 performs the idle rotation. Referring to FIG. 12C, as the controller 124 performs the idle rotation, the gear rotational body 100 immediately rotates in the clockwise direction, and the extension portion 102 moves toward the front. Therefore, the detection arm 122 disengages from the extension portion 102 and returns to the predetermined position by the urging force from the coil spring 123. Thus, the optical sensor 121 stops the output of the on signal. Specifically, the duration of time that the controller 124 receives the on signal is less than that when the first developer cartridge 28 is attached to the body casing 2.

Subsequently, referring to FIG. 12D, the gear rotational body 100 rotates unreversibly. Then, the controller 124 completes the idle rotation and performs the cartridge condition and the cartridge type detection based on the presence or the absence of the on from the optical sensor 121 and the duration of time that the controller 124 receives the on signal.

Figures 13A, 13B:
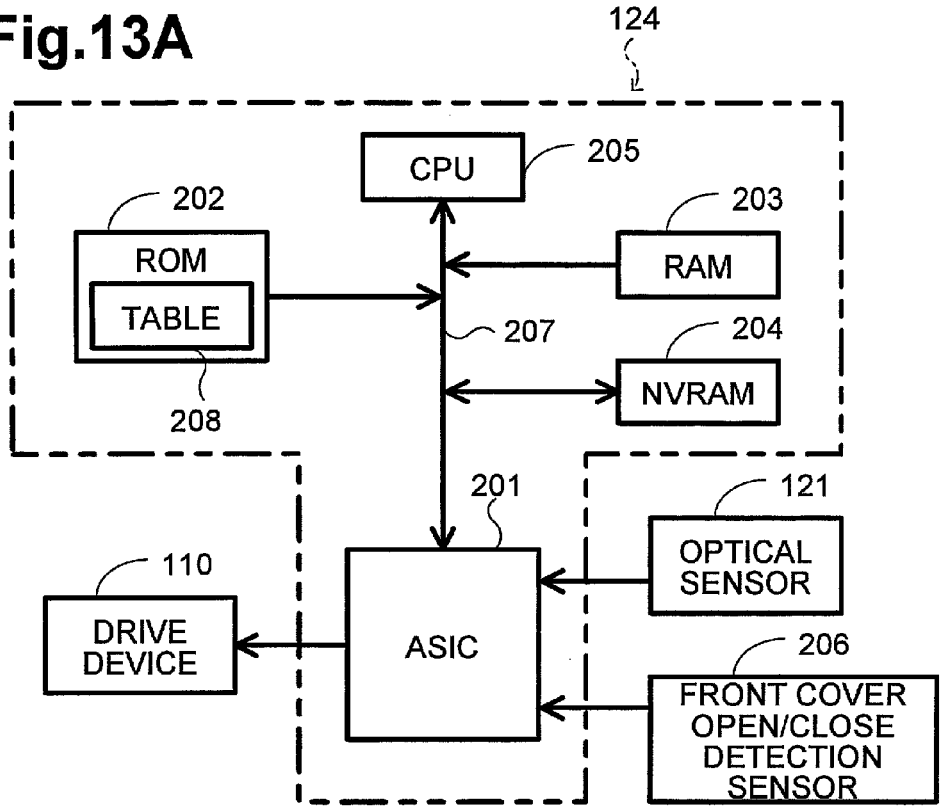
FIG. 13A is a block diagram of a controller of the laser printer of FIG. 1, according to an embodiment of the present invention.
FIG. 13B is a diagram showing a table stored in a ROM of FIG. 13A.

The detection of the cartridge condition and the cartridge type now will be described. Referring to FIG. 13A, the controller 124 may comprise an application-specific integrated circuit (ASIC) 201, a storage, e.g., a read-only memory (ROM) 202, a random-access memory (RAM) 203, a non-volatile random-access memory (NVRAM) 204, and a central processing unit (CPU) 205.

The ASIC 201 may be configured to control the units of the laser printer 1. The ASIC 201 is coupled to the drive device 110, the optical sensor 121, and a front cover open/close detection sensor 206. Although not shown, the front cover open/close detection sensor 206 may comprise a switch which is turned on by the contact of the front cover 2*a*. The front cover open/close detection sensor 206 is turned on and inputs a cover close detection signal to the CPU 205 via the ASIC 201 when the opened front cover 2*a* is closed with respect to the body casing 2. The drive device 110 (the motor) is controlled by the AISC 201 via the execution of various programs by the CPU 205. The ASIC 201 is coupled to the ROM 202, the RAM 203, the NVRAM 204, and the CPU 205 via a bus 207.

The ROM 202 may be configured to store various programs to be executed by the CPU 205, such as a program for performing the cartridge condition and the cartridge type detection. The ROM 202 also may be configured to store a table 208 which is referred to during the cartridge condition and the cartridge type detection. The table 208 sets forth correspondences between times required between when the driving of the drive device 110 starts and when the optical sensor 121 transitions to the off state, e.g., an extension portion moving time, and the types of the developer cartridge 28.

Referring to FIG. 13B, when the extension portion moving time is a, the cartridge type is the first developer cartridge 28, and when the extension portion moving time is β, the cartridge type is the second developer cartridge 28.

Figure 14:
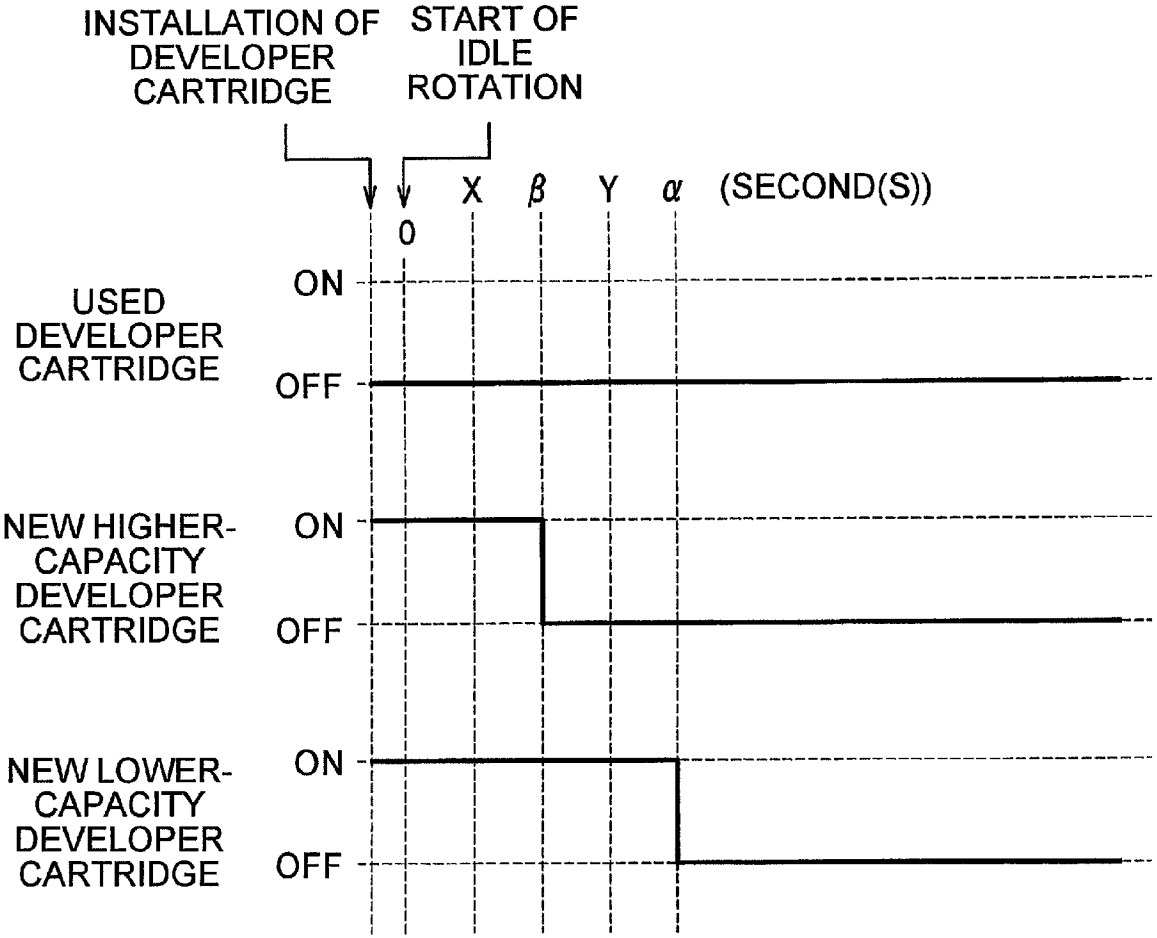
FIG. 14 is a timing chart showing a state of an optical sensor during a cartridge condition and cartridge type detection.

The RAM 203 may be configured to temporarily store numerical values when the various programs are preformed. Referring to FIG. 14, the NVRAM 204 may be configured to store the presence or the absence of the input of a light reception signal in the optical sensor 121, and a measurement time of the input of the light reception signal. The cartridge condition and the cartridge type detection is performed when the CPU 205 performs the cartridge condition and the cartridge type detection program stored in the ROM 202 and the ASIC 201 controls the units.

Figure 15A:
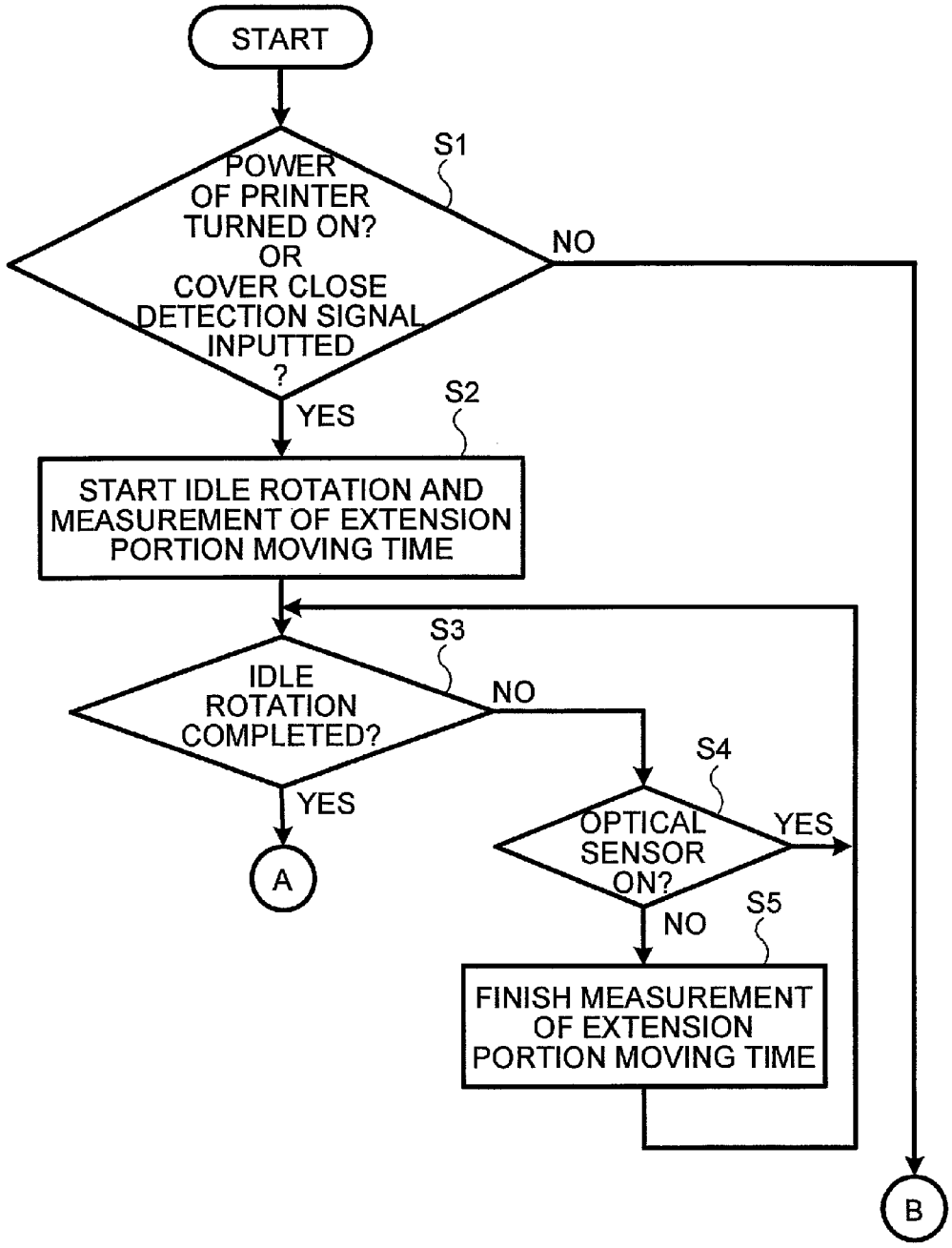
FIG. 15A is a flowchart of the cartridge condition and the cartridge type detection according to another embodiment of the present invention.
Figure 15B:
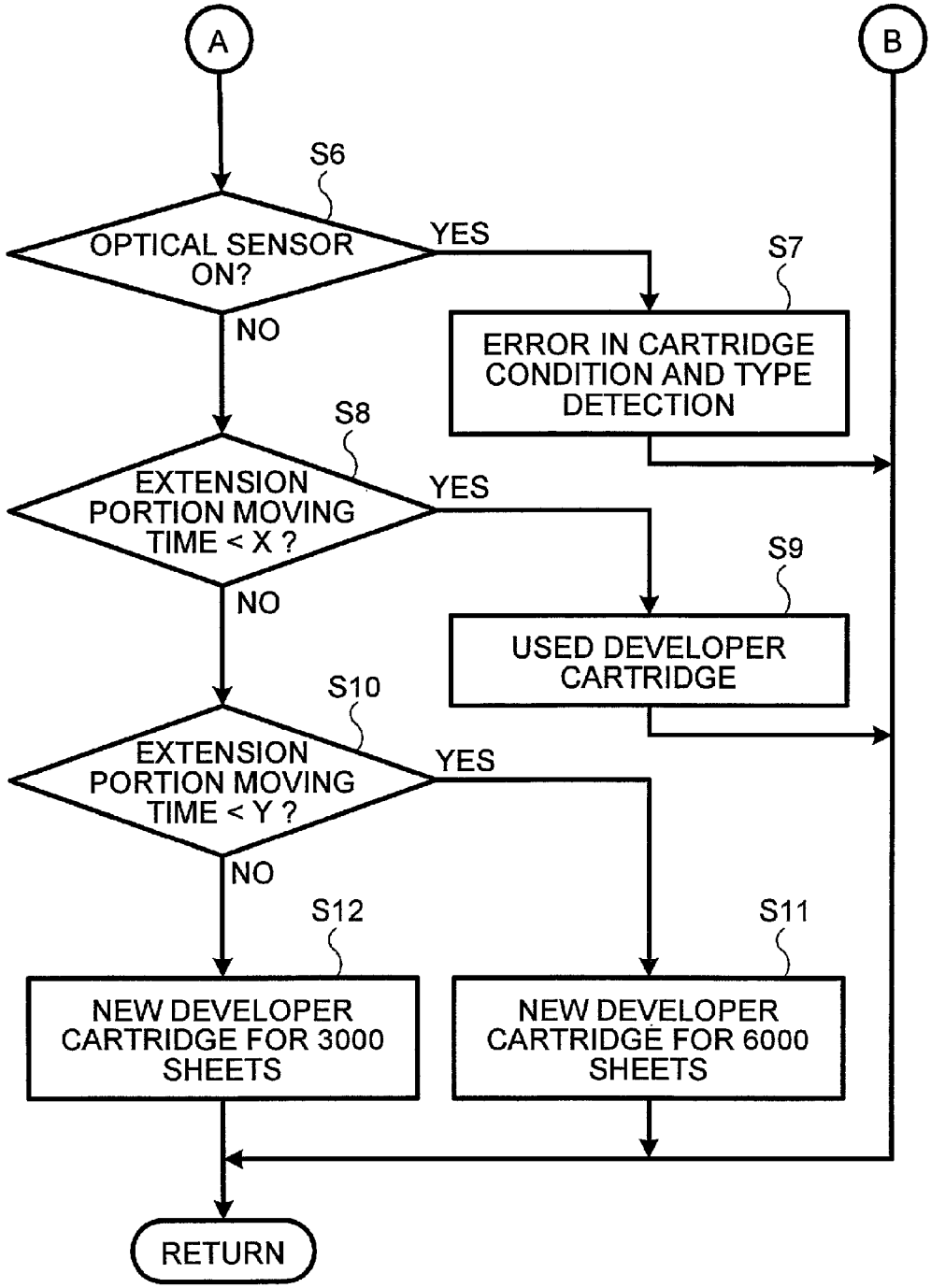
FIG. 15B is a continuation of the flowchart of FIG. 15B.
Figure 16:
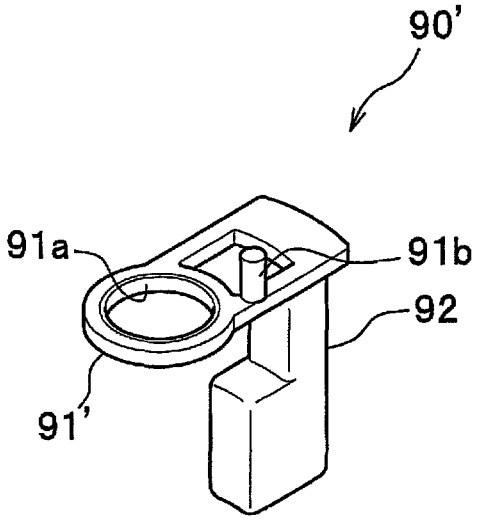
FIG. 16 is a perspective view of a rotational body, according to another embodiment of the present invention.

Referring to FIGS. 14, 15A, and 15B, the cartridge condition and the cartridge type detection now is described. Referring to FIG. 14, timing of the transition between the on state and the off state of the optical sensor 121 in each case when a new second developer cartridge 28, a new first developer cartridge 28, or an used developer cartridge 28 is installed in the body casing 2 is described below. As the new second developer cartridge 28 is attached to the body casing 2, the extension portion 102 contacts the detection arm 122, and the optical sensor 121 transitions to on state, i.e., the input of the light reception signal into the CPU 205 begins via the swing of the detection arm 122.

Subsequently, when the CPU 205 controls the drive device 110 to drive to perform the idle rotation, the extension portion 102 disengages from the detection arm 122, and the detection arm 122 returns to the predetermined position. Thus, the optical sensor 121 transitions to the off state, i.e., the input of the light reception signal to the CPU 205 is stopped. Specifically, when the new second developer cartridge 28 is attached to the body casing 2, the extension portion moving time is β seconds.

As the new first developer cartridge 28 is attached to the body casing 2, the extension portion 92 contacts the detection arm 122. Thus, the detection arm 122 swings toward the front, and the optical sensor 121 transitions to the on state. Then, when the CPU 205 controls the drive device 110 to drive to perform the idle rotation, only the engagement gear 80 rotates by the predetermined amount of time, such that the extension portion 92 becomes in the fixed state, and the optical sensor 121 is maintained in the on state. When the second regulating rib 85 of the engagement gear 80 and the projection 91*b* of the rotational body 90 engage, the rotational body 90 rotates together with the engagement gear 80, and the extension portion 92 disengages from the detection arm 122. Thus, the detection arm 122 returns to the predetermined position, and the optical sensor 121 transitions to the off state.

Specifically, when the new first developer cartridge 28 is attached to the body casing 2, the extension portion moving time is a seconds, which is greater than the extension portion moving time of β seconds when the new second developer cartridge 28 is attached.

When the used developer cartridge 28, such as an used second developer cartridge or an used first developer cartridge, is attached to the body casing 2, the extension portion 92, 102 is located at the front end portion in the elongated groove 73, such that the extension portion 92, 102 does not engage with the detection arm 122. Thus, the optical sensor 121 is maintained in the off state.

Letters "X (seconds)" and "Y (seconds)," shown in FIG. 14, are threshold values to be used in the cartridge condition and the cartridge type detection, in which X is a threshold value set between 0 second and β seconds, and Y is a threshold value set between β seconds and a seconds.

Referring to FIGS. 15A and 15B, the cartridge condition and the cartridge type detection to be performed by the CPU 205 now is described. First, it is determined whether the power of the laser printer 1 has been turned on or whether a cover close detection signal has been inputted to the CPU 205 (Step 1, hereinafter S stands for a step). When it is determined that the power of the laser printer 1 has not been turned on or a cover close detection signal has not been inputted to the CPU 205 from the front cover open/close detection sensor 206 (S1:NO), flow returns to a main routine (not shown) and repeats the determination of S1. When it is determined that the power of the laser printer 1 has been turned on or a cover close detection signal has been inputted to the CPU 205 (S1:YES), the idle rotation is performed (S2). At S2, the CPU 205 outputs a predetermined drive signal to the drive device 110, and allows the counter (not shown) to measure the extension portion moving time. The measurement of the extension portion moving time only is performed when the optical sensor 121 is in the on state.

After the idle rotation begins, it is determined whether the idle rotation has been completed (S3). When it is determined that the idle rotation has not yet been completed, e.g., the idle rotation is still being performed (S3:NO), it is determined whether the optical sensor 121 is in the on state, i.e., a light receiving signal is inputted (S4).

When it is determined that the optical sensor 121 is in the on state (S4:YES), flow returns to S3 to determine again whether the idle rotation has been completed. When it is determined that the optical sensor 121 is in the off state (S4:NO), the CPU 205 allows the counter to stop the measurement of the extension portion moving time (S5). After that, flow goes back to S3.

When it is determined that the idle rotation has been completed (S3:YES), it is determined whether the optical sensor 121 is in the on state (S6). When it is determined that the optical sensor 121 is in the on state (S6:YES), the extension portion moving time has not been correctly measured because the extension portion 92, 102 and the detection arm 122 are still in contact with each other even though, for example, the idle rotation has been completed. Therefore, it is determined that an error has occurred during the cartridge condition and the cartridge type detection (S7), and flow returns to the main routine. When it is determined that an error has occurred during the cartridge condition and the cartridge type detection, a display on an operating panel (not shown) may indicate that the error occurred.

When it is determined that the optical sensor 121 is in the off state (S6:NO), it is determined that the extension portion moving time has been correctly measured, and it is determined whether an obtained value of the extension portion moving time is less than the threshold value X (S8). When it is determined that the value of the extension portion moving time is less than the threshold value X (S8:YES), it is determined that the installed developer cartridge 28 is an used cartridge (S9), and flow returns to the main routine. When it is determined that the installed developer cartridge 28 is an used cartridge, the CPU 205 counts up the number of sheets that have been printed every time printing is performed on a sheet, from the number of sheets that have been printed that was counted up and stored before the developer cartridge 28 was removed from the body casing 2 since the installed developer cartridge 28 has been determined as a new one.

When it is determined that the value of the extension portion moving time is not less than the threshold value X (S8:NO), it is determined whether the value of the extension portion moving time is less than the threshold value Y (S10). When it is determined that the value of the extension portion moving time is less than the threshold value Y (S10:YES), it is determined that the extension portion moving time is seconds. After that, the table 208 stored in the ROM 202 is referred to, and it is determined that the installed developer cartridge 28 is a new second developer cartridge 28 (S11). Then, flow returns to the main routine. When it is determined that the installed developer cartridge 28 is a new second developer cartridge 28, the CPU 205 will indicate via the operating panel that the toner is empty. Specifically, the CPU 205 will indicate that the toner is empty when a sheet discharge sensor (not shown) detects 6000 sheets on which images are formed after the second developer cartridge 28 is attached.

When it is determined that the value of the extension portion moving time is not less than the threshold value Y (S10: NO), it is determined that the value of the extension portion moving time is greater than or equal to the threshold value Y, e.g., the extension portion moving time is a seconds. After that, the table 208 is referred to and it is determined that the installed developer cartridge 28 is a new first developer cartridge 28. Then, flow returns to the main routine. When it is determined that the installed developer cartridge 28 is a new first developer cartridge 28, the CPU 205 will indicate via the operating panel that the toner is empty. Specifically, the CPU 205 will indicate the toner is empty when the sheet discharge sensor detects 3000 sheets on which images are formed after the first developer cartridge 28 is attached.

As illustrated, the engagement gear 80 rotates separately from the rotational body 90 while the engagement gear 80 and the rotational body 90 transition to the second state from the first state, such that the movement of the extension portion 92 may be restricted even when an undesired rotational force is transmitted to the engagement gear 80 via the gear mechanism 61 due to an unintentional operation by the user.

The cartridge condition and the cartridge type detection may be accurately performed using the transmission system configured to transmit the rotational force from the transmission gear 67 to the extension portion 92, 102 and comprising a single or two components, and the rotation start time of the rotational body 90 and the gear rotational body 100 is accurately determined based on the types of the developer cartridges 28 to be used. In addition, although the start timing of the movement of the extension portions 92, 102 is different from each other, the moving distance of the extension portions 92, 102 is the same. Therefore, it is not necessary to increase the rotational amount of the rotational body, e.g., a size of a groove so as to contact the two contact protrusions to the actuator. Accordingly, the developer cartridge 28 may be reduced in size.

The moving distance of the extension portion 92, 102 may be increased to accurately detect the movement of the extension portion 92, 102 by the detector. The diameter of the rotational body 90 may be increased to increase the moving distance of the extension portion 92. Nevertheless, the increase of the diameter of the rotational body 90 may cause an increase in the size of the developer cartridge 28. As described above, the rotational body 90 and the engagement gear 80 may be positioned as separate parts, and the rotational body 90 may comprise the arm-like portion which is has a length greater than the radius of the engagement gear 80. Accordingly, a sufficient moving distance of the extension portion 92 may be achieved while retaining the compactness of the developer cartridge 28.

The extension portion 92 is relatively moved toward the front with respect to the first developer cartridge 28 by the contact arm 122*c*, and the toothed portion 82*a* of the engagement gear 80 engages the transmission gear 67 when the first developer cartridge 28 is attached to the body casing 2. With this structure, unless a force is applied to the extension portion 92, the toothed portion 82*a* of the engagement gear 80 and the transmission gear 67 are separated from each other while the developer cartridge 28 is not attached to the body casing 2. Therefore, even if the gears 62-67 of the first developer cartridge 28 are rotated during product testing before shipping, the engagement gear 80 and the rotational body 90 do not rotate with the gears 62-67, such that the extension portion 92 may be maintained at an appropriate position until the developer cartridge 28 is first attached to the body casing 2.

The second support shaft portion 72 of the cover member 70 may comprise the engaging portion 72*a* configured to maintain the state in which the toothless portion 82*b* of the engagement gear 80, or the toothless portion 105 of the gear rotational body 100, and the transmission gear 67 face each other until a predetermined amount of force is applied to the engagement gear 80. With this structure, the extension portion 92, 102 may be maintained at the appropriate position until the developer cartridge 28 is first attached to the body casing 2.

The engaging portion 72*a* comprises the first contact surface 72*b*, which inclines with respect to the diameter direction of the second support shaft portion 72 and contacts the surface of the engaging groove 81*a*, and the second contact surface 72*c*, which extends along the diameter direction of the second support shaft portion 72 and contacts the other surface of the engaging groove 81*a*. With this structure, the engagement gear 80 may be configured to rotate in the one direction, such that the unreversible rotation of the engagement gear 80 may be reliably performed.

The second support shaft portion 72 may comprise the support surface 72*e* which supports the engaging portion 72*a* when the engaging portion 72*a* is pressed by the engagement gear 80 via the second contact surface 72*c*. With this structure, the reverse rotation of the engagement gear 80 is prevented by the support surface 72*e*, such that the unreversible rotation of the engagement gear 80 may be reliably performed.

The transmission gear 67 may comprise the reduction gear configured to reduce the speed of the rotation of the engagement gear 80. Therefore, the extension portion moving time may be adjusted within the wide range, such that the type of the installed developer cartridge 28 may be reliably detected. Even if the gears 62 to 66 configured to transmit a rotational force to the transmission gear 67 are undesirably rotated due to an accidental operation by the user, the transmission gear 67 reduces the speed of the engagement gear 80, such that the rotation of the engagement gear 80 may be restricted. Thus, the movement of the extension portion 92 may be minimized until the developer cartridge 28 is first attached to the body casing 2.

The cover member 70 may comprise the rotational body 90 and the engagement gear 80. With this structure, the developer cartridge 28 readily may be assembled by attaching the cover member 70 to the cartridge body 60 after the rotational body 90 and the engagement gear 80 are attached to the cover member 70.

The protection wall 75 may be positioned on the front side of the elongated groove 73 to surround the extension portion 92, 102 from the three directions, e.g., from the rear, the front and the bottom. With this structure, the protection wall 75 protects the extension portion 92, 102 from the application of an external force from the three directions when the extension portion 92, 102 is located at the front end position in the elongated groove 73. Thus, for example, when the developer cartridge 28 is removed from the body casing 2 due to paper jam, the extension portion 92, 102 may be protected by the protection wall 75, such that the misdetection during the cartridge condition detection due to the accidental operation by the user may be minimized.

The toothed portion 82*a* and the toothed portion 104 are inwardly deformable in the diameter direction of the engagement gear 80 and the gear rotational body 100, respectively. With this structure, even if the developer cartridge 28 is forcibly attached to the body casing 2 and the engagement gear 80 or the gear rotational body 100 rotates and the toothed portion 82*a* or the toothed portion 104 forcibly contacts the transmission gear 67, the impact of the collision may be absorbed. In addition, even if the tips of the teeth of the toothed portion 82*a*, 104 and the transmission gear 67 contact each other, the tips of the teeth of the toothed portion 82*a*, 104 and the transmission gear 67 slip off each other due to the deformation of the toothed portion 82*a*, 104, such that the toothed portion 82*a*, 104 and the transmission gear 67 may be surely engaged with each other.

In the states shown in FIGS. 10B and 10C, the extension portion 92 is supported by the contact wall 74*a* with the predetermined frictional force, such that the detection arm 122 may be maintained at the position.

The second regulating rib 85 of the engagement gear 80 and the projection 91*b* of the rotational body 90 are used as an example of an adjuster. For example, the transmission gear 67 may be used as an example of the adjuster by changing its gear ratio based on the types of the developer cartridges 28 to be used, instead of adopting the gear rotational body 100 in the both types of the developer cartridges 28.

The rotational body 90 may be shaped in another manner. For example, referring to FIG. 16, a rotational body 90' may comprise a rotational frame 91' having substantially rectangular plate shape if the rotational body 90' has an opening 91*a*, a projection 91*b*, and an extension portion 92 which are the same as those of the rotational body 90 described above. Specifically, the circular rib 93 may be omitted.

Figure 17A:
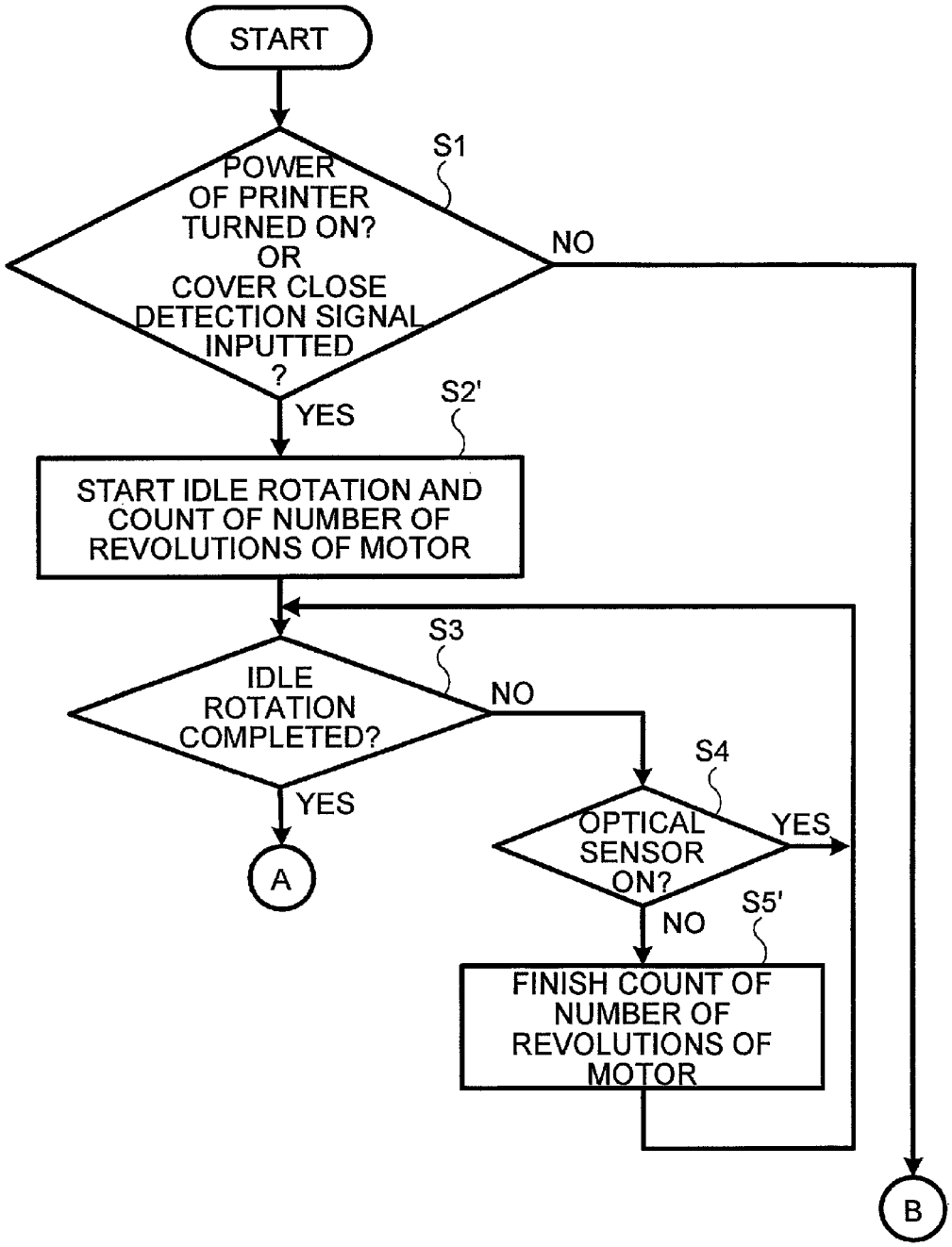
FIG. 17A is a flowchart of a cartridge condition and a cartridge type detection, according to yet another embodiment of the present invention, in which the condition and the type of an installed developer cartridge are detected by a rotational amount of a motor.
Figure 17B:
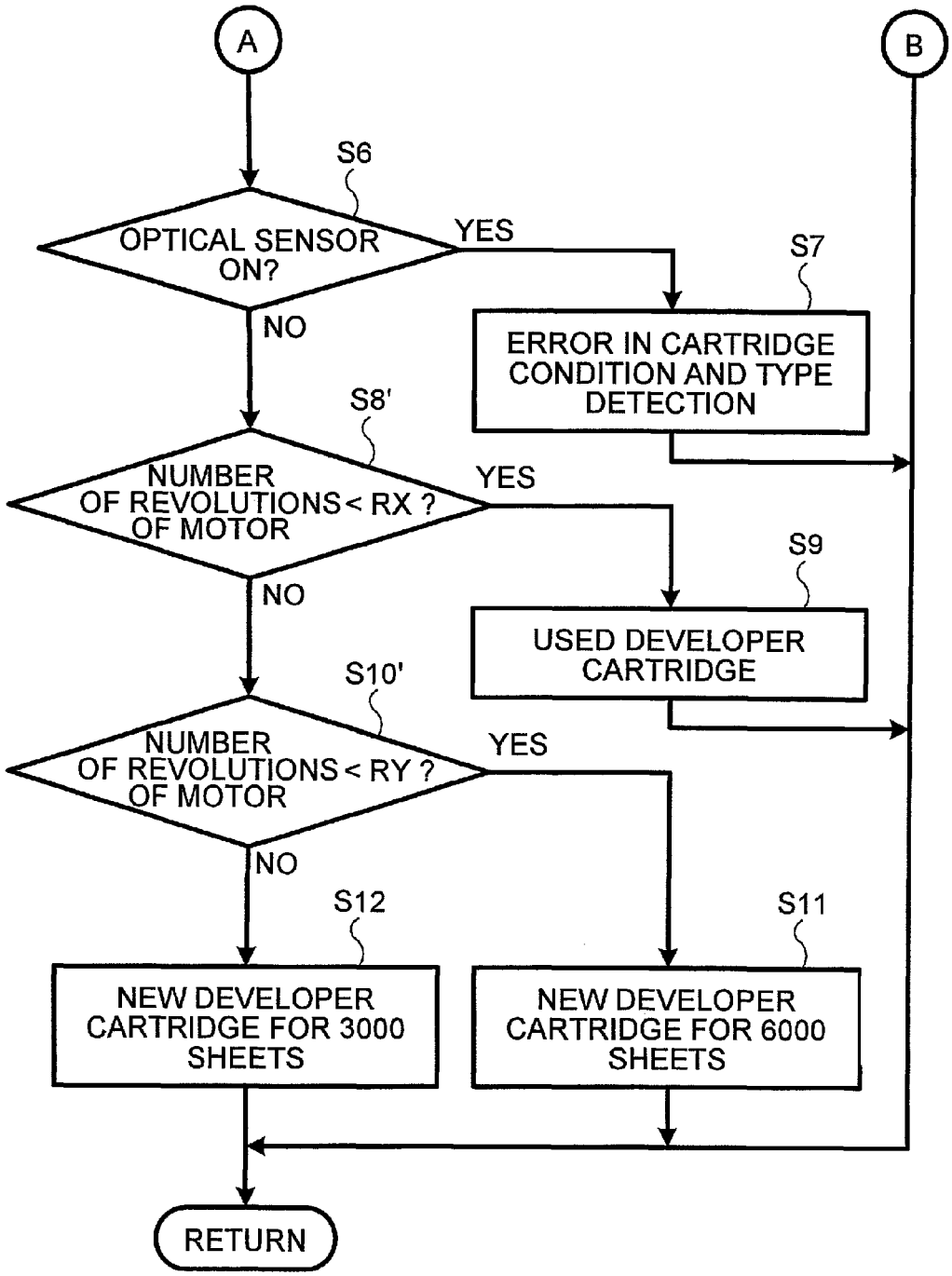
FIG. 17B is a continuation of the flowchart of FIG. 17A.

As illustrated, the type of the installed developer cartridge 28 is detected based on the time elapsed between when the driving of the drive device 110 starts and when the optical sensor 121 becomes in the off state. For example, the type of the installed developer cartridge 28 may be detected based on a drive amount of the drive device 110 required between when the driving of drive device 110 starts and when the optical sensor 121 becomes in the off state is detected by the optical sensor 121. In this case, a known revolution per minute ("RPM") detection sensor may be positioned in the drive device 110, and the controller 124 may count the number of revolutions during the extension portion moving time $\alpha$ or $\beta$. In this case, the extension portion moving time $\alpha$, $\beta$ of the table 208 shown in FIG. 13B may be changed to the number of revolutions of the motor R$\alpha$ and R$\beta$ counted during the extension portion moving time $\alpha$ and $\beta$ and the control may be performed in accordance with the flowchart of FIGS. 17A and 17B. In the flowchart of FIGS. 17A and 17B, the extension portion moving time of FIGS. 15A and 15B has been changed to the number of revolutions of the motor. For example, S2', S5', S8', and S10' of FIGS. 17A and 17B, at which processing to be performed, may be different from S2, S5, S8, and S10 of FIGS. 15A and 15B.

At S2', the controller 124 starts the idle rotation and the count of the number of revolutions of the motor. At S5', the controller 124 stops the count of the number of revolutions of the motor. At S8', it is determined whether the number of revolutions of the motor actually obtained during the time between S2' and S5' is less than the number of revolutions of the motor RX which is predetermined to be obtained during the time X of the threshold value. At S10', it is determined whether the number of revolutions obtained during the time between S2' and S5' is less than the number of revolutions of the motor RY which is predetermined to be obtained during the time Y of the threshold value. By performing the processing of S2', S5', S8' and S10', the cartridge condition and the cartridge type detection also may be accurately performed.

When the detection of the extension portion moving time of FIGS. 15A and 15B or the detection of the number of revolutions of the motor of FIGS. 17A and 17B is performed, an accumulated value of the time elapsed to move the extension portion 92, 102 or an accumulated value of the number of revolutions of the motor may be periodically stored in a nonvolatile memory during the detection. By doing so, for example, if the power of the laser printer 1 is turned off during the idle rotation, the value stored in the memory may be referred to when the power of the laser printer 1 is turned on next time. Accordingly, an appropriate control may be performed in consideration of the actions of the engagement gear 80 and the rotational body 90 before the power of the laser printer 1 is turned off.

As illustrated, the detection arm 122 is supported by a shaft at its substantially middle portion so as to be swingable. For example, one end of a detection arm may be supported by a shaft. In this case, the other end of the detection arm is positioned at a position at which the detection arm may contact a rotational arm, and a portion between the one end and the other end of the detection arm may be positioned between a light emitting portion and a light receiving portion of an optical sensor.

As illustrated, the toothed portion 82*a*, 104, and the transmission gear 67 are engaged with each other by contacting the extension portion 92, 102 and the detection arm 122 with each other when the developer cartridge 28 is attached to the body casing 2. The extension portion 92, 102 may be contacted with any portion of the body casing 2. However, a parts count may be restricted if the extension portion 92, 102 is contacted with the detection arm 122.

As described above, the optical sensor 121 is used as an example of the detector. For example, a distance sensor configured to detect a position of an end portion of a detection arm, such as an ultrasonic sensor and an optical sensor, may be used as an example of the detector. Alternatively, a leaf spring may be provided so as to contact a detection arm and a strain gauge may be provided to the leaf spring, such that the swing of the detection arm can be detected.

As illustrated, the coil spring 123 that urges the detection arm 122 is used as an example of an elastic member. A torsion spring or a leaf spring may be used instead of the coil spring 123.

The engaging groove 81*a* of the engagement gear 80 and the engaging portion 72*a* of the second support shaft portion 72 are used as an example of the regulating member. For example, an engagement gear may comprise an engaging portion deformable in a diameter direction of the engagement gear and a second support shaft portion may have a groove with which the engaging portion of the engagement gear engages. The first contact surface of the engaging portion 72*a* may be formed in an arc-shape.

As described above, the transmission system in the first developer cartridge 28 is implemented by two components of the engagement gear 80 and the rotational body 90 and the transmission system in the second developer cartridge 28 is implemented by a single component of the gear rotational body 100. Alternatively, the transmission system in the first developer cartridge 28 may be implemented by a single component and the transmission system in the second developer cartridge 28 may be implemented by two components.

Referring to FIG. 17, the known RPM detection sensor may be positioned to the drive device 110 and the controller 124 counts the number of revolutions of the motor Rα, Rβ. The known RPM detection sensor may be provided to an intermediate gear between a drive device and an extension portion and the controller 124 may be configured to count the number of revolutions of the motor Rα, Rβ.

The extension portion 92 of the rotational body 90 contacts and slides over the contact wall 74*a* in the states shown in FIGS. 10B to 10D only. However, the extension portion 92 may also contact and slide over the contact wall 74*a* in the states shown in FIGS. 10A and 10E. A portion that contacts and slides over a rotational body may be provided at a position other than an opening through which the extension portion 92 passes to the outside, to maintain the extension portion 92 at the predetermined position (e.g. the position shown in FIG. 10C), instead of the contact wall 74*a*.

Figure 18A:
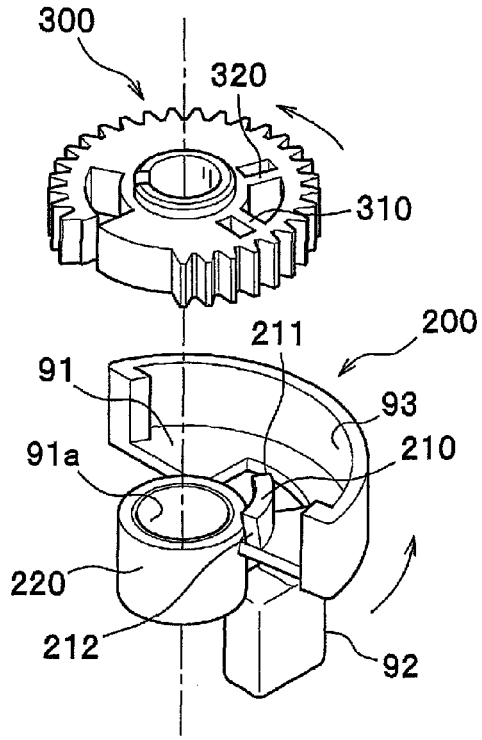
FIG. 18A is an enlarged, perspective view of right sides of an engagement gear and a rotational body, according to yet another embodiment of the present invention.
Figure 18B:
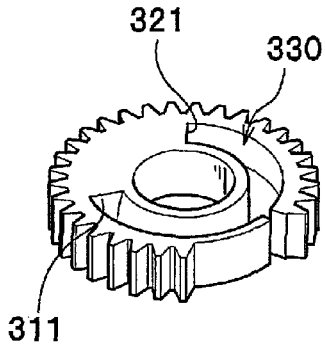
FIG. 18B is a perspective view of a left side of the engagement gear of FIG. 18A.

The engagement gear and the rotational body may be shaped Referring to FIGS. 18A and 18B. For example, Referring to FIG. 18A, a rotational body 200 may comprise a projection 210 and a cylindrical portion 220, which are differ from the rotational body 90 of FIG. 4, in addition to an opening 91*a*, an extension portion 92, a sector-shape rotational frame 91 and a circular rib 93, which are similar to those of the rotational body 90 of FIG. 4. The projection 210 is an arc-shape rib that extends along the opening 91*a*. The projection 210 comprises a section shape Referring to FIGS. 18C and 18D when viewed from a direction perpendicular to a rotational axis of the rotational body 200. For example, the projection 210 comprises a leading surface 211 and a trailing surface 212 with respect to a rotational direction of the rotational body 200. The leading surface 211 of the projection 210 is inclined in a rotational direction of an engagement gear 300 toward the engagement gear 300. The trailing surface 212 of the projection 210 is inclined in a direction opposite to the rotational direction of the engagement gear 300 toward the engagement gear 300.

Figure 18C:
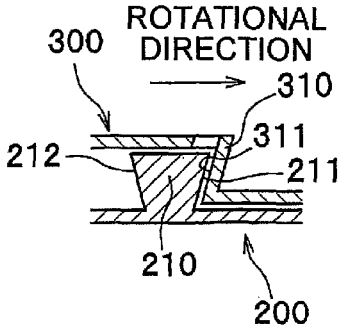
FIG. 18C is a sectional view of the engagement gear and the rotational body of FIG. 18A, illustrating a state where a leading surface of a projection of the rotational body contacts a first engaging surface of a first regulating rib of the engagement gear when viewed from a direction perpendicular to a rotational axis of the rotational body of FIG. 18A.
Figure 18D:
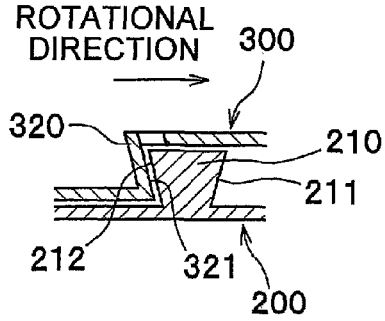
FIG. 18D is a sectional view of the engagement gear and rotational body of FIG. 18A, illustrating a state where a trailing surface of the projection of the rotational body contacts a second engaging surface of a second regulating rib of the engagement gear when viewed from the direction perpendicular to the rotational axis of the rotational body of FIG. 18A.

Referring to FIG. 4C, the engagement gear 300 may comprise a first regulating rib 310 and a second regulating rib 320 at substantially same positions where the first regulating rib 84 and the second regulating rib 85 of the engagement gear 80 may be positioned in the engagement gear 80. The first regulating rib 310 and the second regulating rib 320 are inclined so as to extend along the leading and trailing faces 211, 212 of the projection 210, respectively. Referring to FIG. 18B, the first regulating rib 310 comprises a first engaging surface 311 and the second regulating rib 320 comprises a second engaging surface 321. Referring to FIG. 18C, the first engaging surface 311 of the first regulating rib 310 is inclined in a direction opposite to the rotational direction of the engagement gear 300 toward the rotational body 200. Referring to FIG. 18D, the second engaging surface 321 of the second regulating rib 320 is inclined in the rotational direction of the engagement gear 300 toward the rotational body 200. Thus, when the projection 210 and the first regulating rib 310 are contacted with each other and when the projection 210 and the second regulating rib 320 are contacted with each other, a force is applied on the rotational body 200 and the engagement gear 300 such that the rotational body 200 and the engagement gear 300 push each other. Accordingly, the rotational body 200 and the engagement gear 300 are surely engaged with each other and rotate integrally.

The cylinder portion 220 of the rotational body 200 comprises a wall thickness greater than the plate-like rotational frame 91. For example, the cylinder portion 220 extends from the rotational frame 91 in an extending direction of the extension portion 92. Therefore, in the states shown in FIGS. 10B and 10C, the inclination of the cylindrical portion 220 with respect to the second support shaft portion 72 of the cover member 70 is restricted and a frictional force may be surely applied to the extension portion 92 from the contact wall 74*a*.

Referring to FIG. 18B, the engagement gear 300 comprises a fun-shape regulating groove 330 at its opposite side, such that a misassembling of the engagement gear 300 and the rotational body 200 is prevented.

The hook-shaped engaging portion 72*a* retains the rotational body 90 and the engagement gear 80 so that the rotational body 90 and the engagement gear 80 are not removed from the second support shaft portion 72. For example, referring to FIG. 19A, a cartridge body 60 may comprise a retainer 68 so as to assist in the retaining of the rotational body 90 and the engagement gear 80. The retainer 68 protrudes leftward from a left surface 60*a* of the cartridge body 60.

Figure 19A:
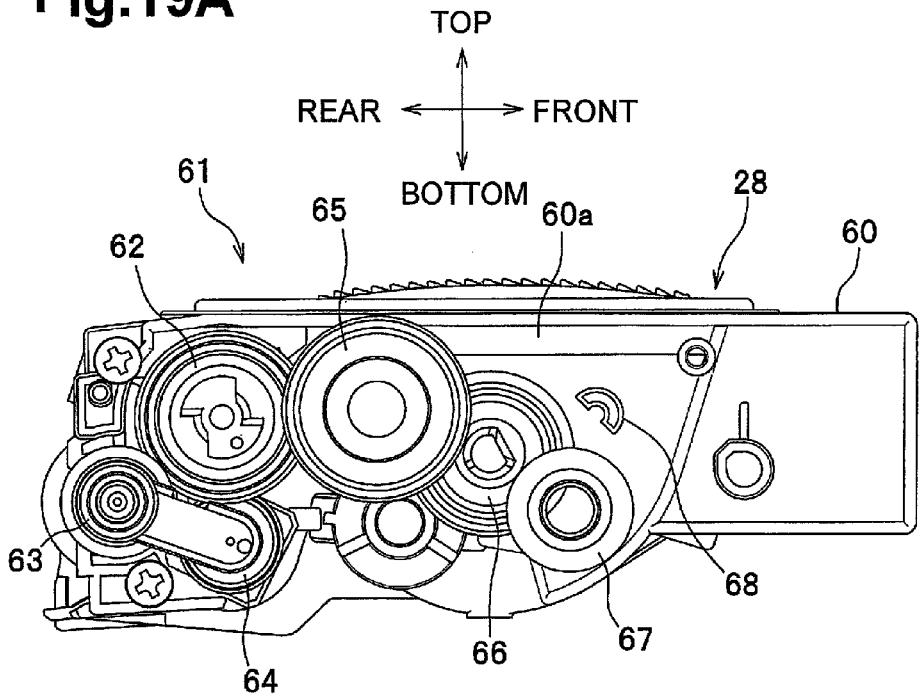
FIG. 19A is a left side sectional view of a cartridge body of a developer cartridge including a retainer at its left side surface, according to still yet a further embodiment of the present invention.
Figure 19B:
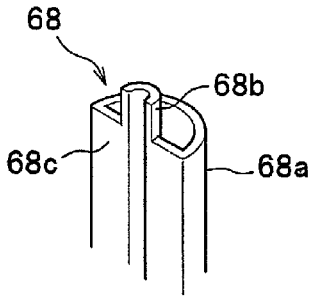
FIG. 19B is a perspective view of the retainer of FIG. 19A.
Figure 19C:
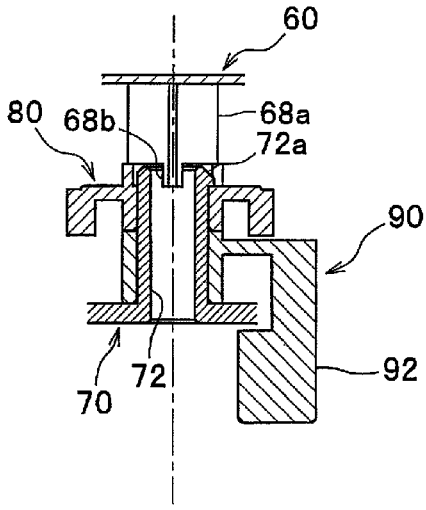
FIG. 19C is an enlarged, cross-sectional view of the retainer of FIG. 19A, the engagement gear, the rotational body, and the cover member illustrating a relationship therebetween.

For example, referring to FIG. 19B, the retainer 68 may comprise a larger-diameter portion 68*a* having a semicircular cylindrical shape, and a smaller-diameter portion 68*b* having a semicircular cylindrical shape, and a connection portion 68*c*. The smaller-diameter portion 68*b* is coaxial with the larger-diameter portion 68*a* and comprises a diameter smaller than that of the larger-diameter portion 68*a*. The connection portion 68*c* connects edges of the larger-diameter portion 68*a* and the smaller-diameter portion 68*c* each other. The smaller-diameter portion 68*b* protrudes from the larger-diameter portion 68*a*. With this structure, referring to FIG. 19C, a tip portion of the smaller-diameter portion 68*b* is inserted into the second support shaft portion 72 and an end of the larger-diameter portion 68*a* contacts an end of the cylindrical portion 81 of the engagement gear 80 when the cover member 70 is attached to the cartridge body 60. By doing so, the engagement gear 80 is surely retained at the position even if the engagement bear 80 and the engaging portion 72*a* tend to disengage from each other by which a strong force is applied to the extension portion 92 toward the inside in the diameter direction of the second support shaft portion 72 and the center portion of the rotational body 90 moves in a direction that the rotational body 90 disengages from the second support shaft portion 72. In addition, the retainer 68 provided to the cartridge body 60 contacts the second support shaft portion 72 from the inside, such that the warp of the cover member 70 toward the inside may be reduced and positional accuracy of the engagement gear 80 and the rotational body 90 with respect to the cartridge body 60 may be increased. Accordingly, the cartridge condition and the cartridge type detection may be precisely performed.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A cartridge comprising:

a casing configured to accommodate a developer therein;

a developing roller disposed at the casing and configured to carry the developer;

a first rotational body disposed at the casing; and a second rotational body disposed at the casing and comprising an extension portion that protrudes through an opening to an opposite side of the casing, wherein the extension portion is positioned offset from a center of rotation of the second rotational body, wherein the first rotational body is configured to transmit a driving force to the second rotational body, and wherein the second rotational body is configured to start rotating at a predetermined amount of time after the first rotational body starts rotating, and wherein the second rotational body is configured to rotate in a same rotational direction as the first rotational body rotates.

2. The cartridge of claim 1, wherein the first rotational body comprises a first engaging portion, and the first engaging portion is configured to move along a predetermined path when the first rotational body rotates, and wherein the second rotational body comprises a second engaging portion positioned at a position along the predetermined path.

3. The cartridge of claim 2, wherein the first rotational body and the second rotational body are configured to transition between a first state in which the second engaging portion and the first engaging portion are separated from each other, and a second state in which the second engaging portion engages the first engaging portion, wherein when the first rotational body and the second rotational body are in the second state, the second rotational body is configured to rotate with the first rotational body when the first rotational body rotates.

4. The cartridge of claim 2, wherein the first rotational body comprises:

a first surface facing the second rotational body, wherein the first engaging portion is positioned on the first surface, and wherein the second rotational body comprises:

a second surface facing the first surface, wherein the second engaging portion is positioned on the second surface; and a third surface positioned on a side opposite to the second surface, wherein the second engaging portion is configured to selectively engage the first engaging portion.

* * * * *